US005448790A

United States Patent [19]

Saro et al.

[11] Patent Number: 5,448,790

[45] Date of Patent: Sep. 12, 1995

[54] SELECTIVELY ARRANGEABLE CUSHION ASSEMBLY

[76] Inventors: Jack H. B. Saro; Marguerite B. Saro, both of 3851 Orion Ct., Boulder, Colo. 80304

[21] Appl. No.: 54,800

[22] Filed: Apr. 28, 1993

[51] Int. Cl.[6] ..... A47C 27/00

[52] U.S. Cl. ..... 5/657; 5/427; 5/922

[58] Field of Search ..... 5/657, 655, 652, 465, 5/922, 427, 475, 632

[56] References Cited

U.S. PATENT DOCUMENTS

| | | | |
|---|---|---|---|
| 2,182,861 | 12/1939 | Albert | 5/465 |
| 3,736,023 | 5/1973 | Lyons | 5/465 |
| 4,171,549 | 10/1979 | Morrell et al. . | |
| 4,441,221 | 4/1984 | Enste et al. . | |
| 4,473,913 | 10/1984 | Ylvisaker . | |
| 4,630,323 | 12/1986 | Sage | 5/657 |
| 4,635,306 | 1/1987 | Willey | 5/657 |
| 4,777,678 | 10/1988 | Moore . | |
| 4,802,249 | 2/1989 | Bills | 5/922 |
| 4,853,993 | 8/1989 | Walpin | 5/465 |
| 4,876,755 | 10/1989 | Parrish | 5/922 |
| 4,905,330 | 3/1990 | Jacobs . | |
| 4,987,625 | 1/1991 | Edelson . | |
| 5,056,533 | 10/1991 | Solano | 5/655 |

FOREIGN PATENT DOCUMENTS

| | | | |
|---|---|---|---|
| 1464661 | 9/1965 | France | 5/465 |
| 483941 | 6/1968 | Switzerland | 5/922 |

*Primary Examiner*—Flemming Saether

*Attorney, Agent, or Firm*—Homer L. Knearl; Holland & Hart

[57] ABSTRACT

A wide variety of cushion support arrangements for the body of a human user, for example, adults and children who have experienced neuro-muscular damage, are provided by the selective use and positioning of individual body support cushions comprising an inclined wedge cushion, an alternate form of an inclined wedge cushion, a relatively thick multi- purpose block cushion, a double inclined cushion, a relatively thin block cushion, an abductor block cushion, and half cylinder rolls or rail cushions of various axial lengths.

10 Claims, 21 Drawing Sheets

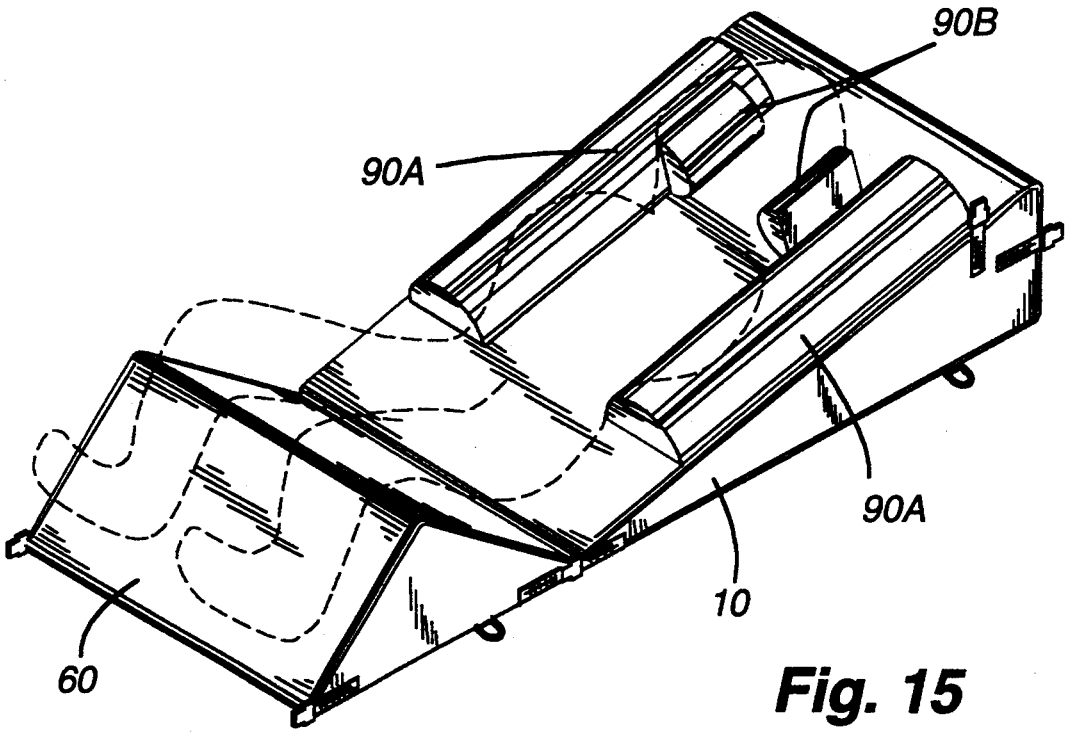
Fig. 15
Fig. 16
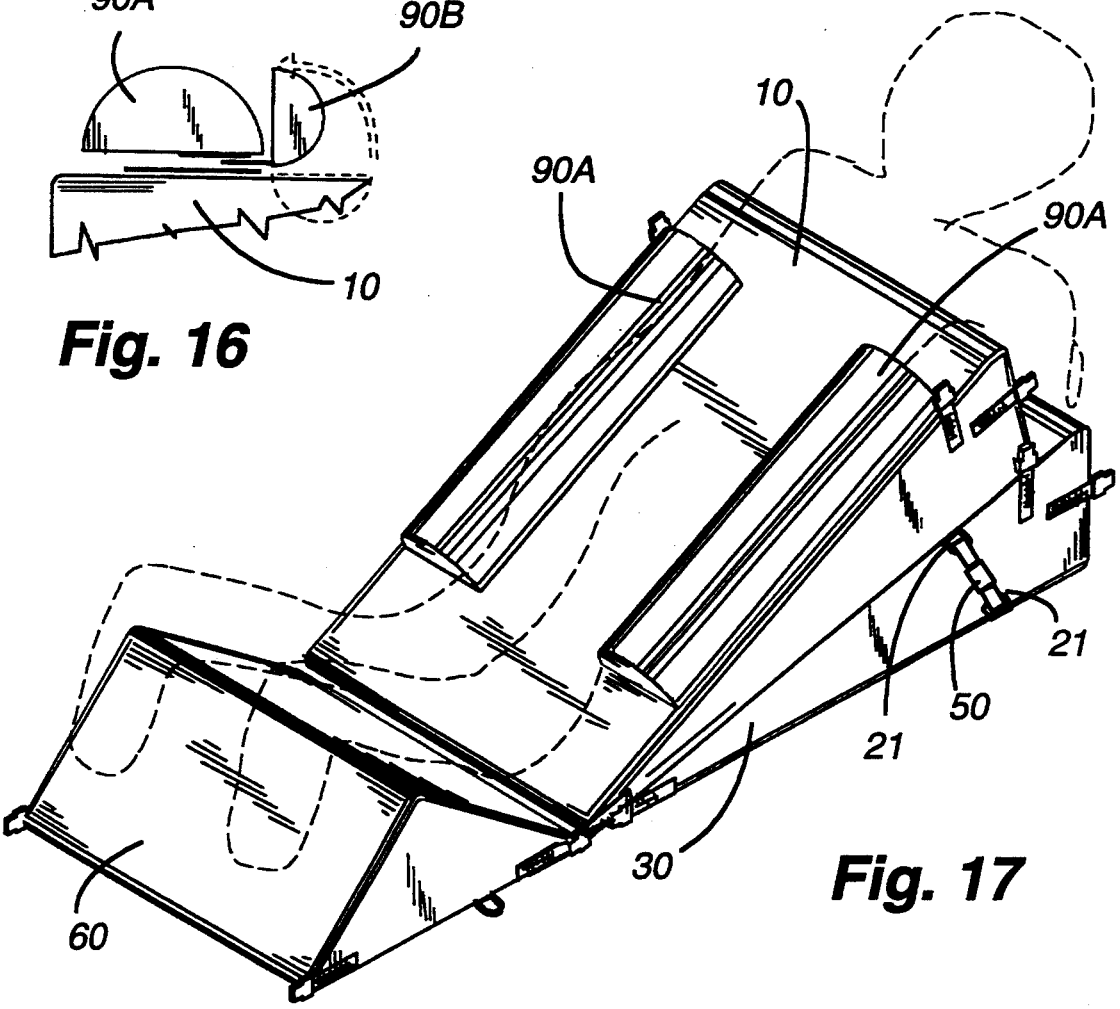
Fig. 17

SELECTIVELY ARRANGEABLE CUSHION ASSEMBLY

FIELD OF THE INVENTION

This invention relates to the field of cushion support means for the body of a human user, the support means generally comprising a sectional, or arrangeable bed or cushion assembly, having a plurality of selectively positionable body support parts or cushions.

BACKGROUND OF THE INVENTION

The present invention relates to adaptive therapeutic positioning equipment, and has special utility for the treatment of adults and children who have experienced neuro-muscular damage, people who are handicapped or are developmentally delayed, and people who are interrupted in physical or mental development by stroke, brain traumatic injury, spinal cord injury, disease, accident or the aging process. While the invention has special utility in such fields, in its broadest sense, the invention is not to be limited thereto.

Therapeutic equipment of this type is of general utility for use in occupational and physical therapy programs, and it is generally considered to be essential in private homes and in hospitals, nursing homes, regional centers, schools and home health care facilities.

The art contains general teachings relating to both therapeutic positioning equipment, and bed or cushion devices having a plurality of selectively positionable body support parts. The following patents are exemplary, and these patents are incorporated herein by reference for the purposes of indicating the background of the invention, and illustrating the state of the art.

U.S. Pat. Nos. 4,905,330 and 4,987,625 teach multicushion devices wherein a plurality of cushions are pivotally interconnected to facilitate selective positioning of the cushions.

U.S. Pat. No. 4,171,549 describes a cushion ensemble wherein three or four unattached and generally triangular-shaped cushions may be arranged to support an individual in a selected one of a number of positions.

U.S. Pat. No. 4,441,221 describes a multi-part child support wedge having a wedge-shaped base plate to which two spaced trough wedges are attached by way of stick-on belts or portions. Various members, such as a semi-cylindrical member, a flat pillow, a flat pillow with an integral abductor, and a head wedge may be attached to the base plate in the area between the two trough wedges. Flat pillows may also be attached to the facing surfaces of the trough wedges. Fixation belts are also provided. The configuration of these parts to accommodate various positions of a child are described.

U.S. Pat. No. 4,473,913 describes a three-part therapeutic support cushion comprising two triangular-shaped pillows and one diamond shaped cushion. The three pillows are arranged to support an individual in a face down position. The two triangular pillows include a channel adapted to receive the head of the individual. Alternatively, the two triangular pillows are spaced apart so as to support an individual in a face up or supine position. The triangular pillows are held in place on a support surface by means of resilient rubber pads.

U.S. Pat. No. 4,777,678 describes a four-pillow arrangement for providing orthopedic support to an individual. In the storage condition, these four pillows are configured to form a cube. The four pillows comprise two triangular-shaped pillows, a cervical pillow and a flat pillow. A pad is provided for mounting the pillows in a variety of positions. Hook and loop fasteners are provided to hold the pillows in selected positions. The triangular pillows also include loops that cooperate with belts for the purpose of securing the pillows to each other.

While prior devices, such as exemplified above, are generally satisfactory for achieving their limited intended function, the need remains in the art for improved adaptive therapeutic positioning equipment having greater utility, particularly in relation to the selective treatment of disabled adults and children.

SUMMARY OF THE INVENTION

This invention provides a wide variety of cushion support arrangements for the body of a human user. The cushion support arrangements are generally formed of a plurality of selectively usable and positionable individual body support cushions. While the invention provides adaptive therapeutic positioning equipment that has special utility for the treatment of disabled adults and children, in its broadest sense, the spirit and scope of the invention is not to be limited thereto.

The goals of equipment of this type of device is to optimize both the posture and the function of the user. When a user's head and trunk are well supported in a sitting or a semi-reclining position, any muscle imbalance between the trunk and neck flexors and extenders are limited. Therefore, more comfort is provided for the user during therapy. The invention provides this result with maximum alternatives for positioning the user in a supine, a prone, a prone kneeling, a prone standing or a sidelying position. Use of the invention reduces the effects of abnormal reflex, muscle tone and synergy activities, and thus provides a base from which functional activity of the user may occur in both play and learning programs or situations.

The invention provides various arrangements whereby the body trunk and limbs of a user having one or more disabilities is selectively supported in semi-inclined prone or supine positions, a sitting position, or a sidelying position. Use of the invention improves and maintains joint flexibility, increases relaxation and physical wellness, and allows all, or selected, parts of the body to be maintained or held in a stable position.

The body of a user is comfortably maintained in a symmetrical and customized aligned position, whereby the user is stimulated to interact in a dynamic fashion with peers, caregivers and therapists; for example, in educational and recreational gatherings. By moving the head of the user vertically to a variety of vertical eye levels, communication and eye contact is achieved in a therapy program.

The above-mentioned individual body support cushions comprise an inclined wedge cushion, an alternate form of an inclined wedge cushion, a relatively thick multipurpose block cushion, a double inclined cushion, a relatively thin block cushion, an abductor block cushion, and half cylinder rolls, or rail cushions having various axial lengths.

In summary, and without limitation thereto, it is an object of the invention to provide therapeutic support apparatus for individuals or patients having little or no muscular control, wherein a plurality of interchangeable cushions or pillows shaped in cross section as wedges, triangles, rectangles and half rounds are interconnected or positioned relative to one another. For example, a triangular cushion may be connected to a wedge cushion so as to match the physical size of a patient, and thereby facilitate particular posture positions of the patient. One or more additional wedge cushions may then be used to adjust the patient's vertical height position; for example, the vertical height of the patient's head and upper body. Cushions interconnecting straps are provided to prevent movement of the cushions, and thus ensure stable positioning of the patient. The cushion surfaces that support the patient are provided with strategically located hook/loop fasteners whereby additional cushions, such as the half rolls, may be attached in a manner to comfortably confine the patient's body in a desired position. Straps having hook/loop fasteners are provided to hold the patient in position and/or the most proper alignment on the cushion's support surface.

These and other advantages and objects of the invention will be readily apparent to those skilled in the art upon reference to following detailed description, which description makes reference to the drawing.

BRIEF DESCRIPTION OF THE DRAWING

FIG. 15 is a front and right side perspective view of various cushions that are interconnected to provide a position of rest and relaxation as the back of a user rests thereon.

FIG. 16 shows how the two different size half rolls of FIG. 12 are interconnected with each other and with the top surface of the wedge cushion of FIG. 15.

FIG. 17 is a front and right side perspective view similar to FIG. 15 wherein an elevated position is provided by the use of an additional inclined wedge cushion as shown in FIG. 2.

FIGS. 29, 30 and 31 show cushion arrangements similar to

FIGS. 26–28 wherein a short block having a larger vertical height is substituted for the short block of FIGS. 26–28.

DETAILED DESCRIPTION OF THE INVENTION

This invention provides various multiple cushion apparatus arrangements whereby a user's body trunk and limbs are selectively supported in a number of different positions. The body of a user is comfortably maintained in virtually any aligned position by apparatus of the invention. In this manner, the user is stimulated to interact in a dynamic fashion with peers, caregivers, therapists, and the like.

As will be apparent, the individual body support cushions comprise the following cushion group; inclined wedge cushion, alternate form of inclined wedge cushion, relatively thick multi-purpose block cushion, double inclined cushion, relatively thin block cushion, abductor block cushion, and half cylinder rolls, or rail cushions of different axial lengths and diameters. Selective use of these cushions provides a system of multiple support cushions that includes belt couplings extending between the cushions whereby an individual may be supported in a variety of positions as the cushions are coupled to form one of a plurality of apparatus combinations.

The invention provides a system of apparatus that is formed from a plurality of resilient and generally flexible cushions, or pillows, having a plurality of shapes and sizes. A number of different support apparatus or modules are thereby formed for the purpose of positioning an individual in therapeutic alignment, thereby optimizing the individual's posture and functioning. Due to the plurality of sizes in which the cushions can be formed, the therapeutic modules are not restricted to individuals of a particular size or age group.

Figure 1:
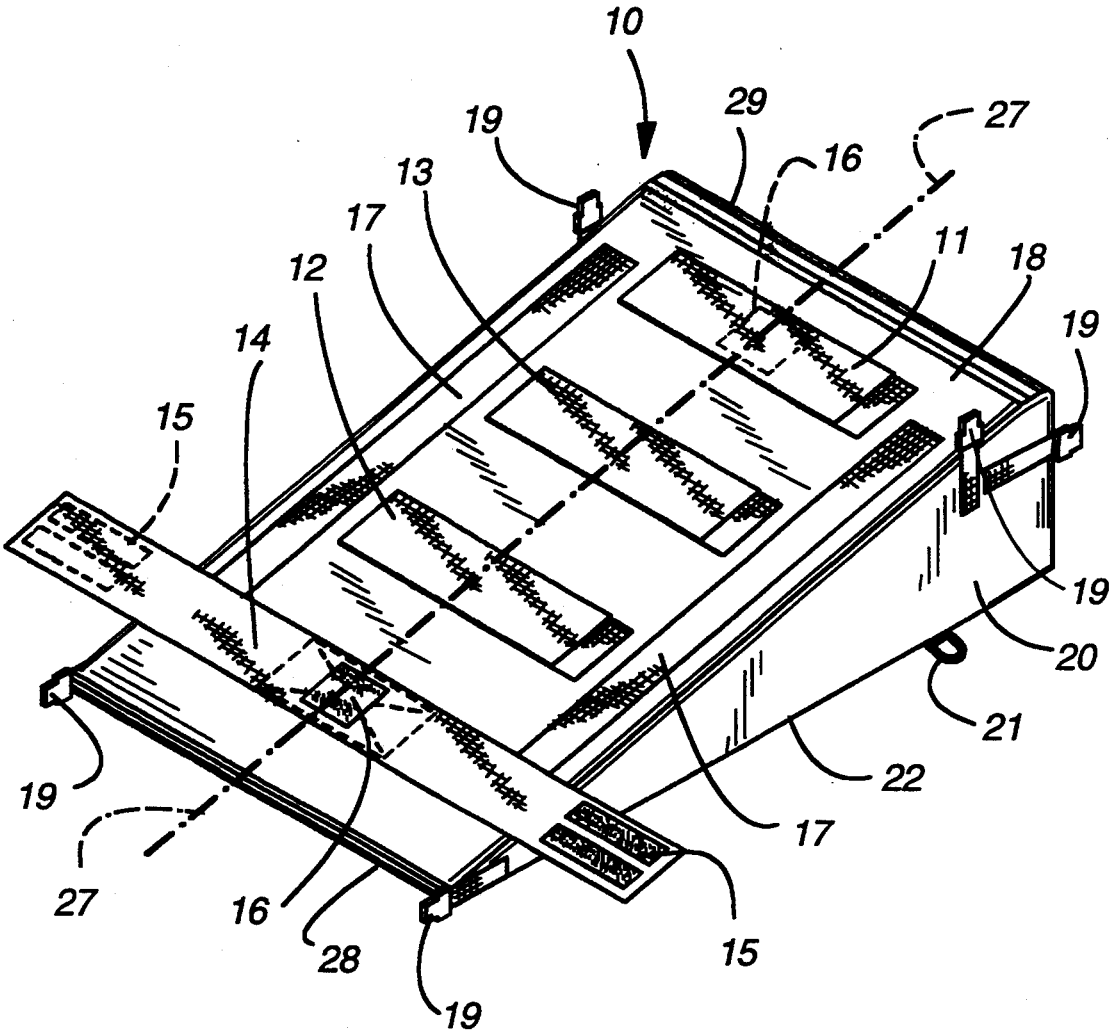
FIG. 1 is a front and right side perspective view of a first form of inclined wedge cushion in accordance with the invention, the cushion having four top-disposed fabric straps, one of which is shown in its unfolded position, a hook/loop fastener patch under each of the four straps, two covered and side disposed hook/loop fastener strips on the top surface of the cushion, three interconnecting hooks located on each of the vertical sides of the cushion, and an interconnection ring located on the bottom edge surface of each side wall of the cushion.
Figure 3:
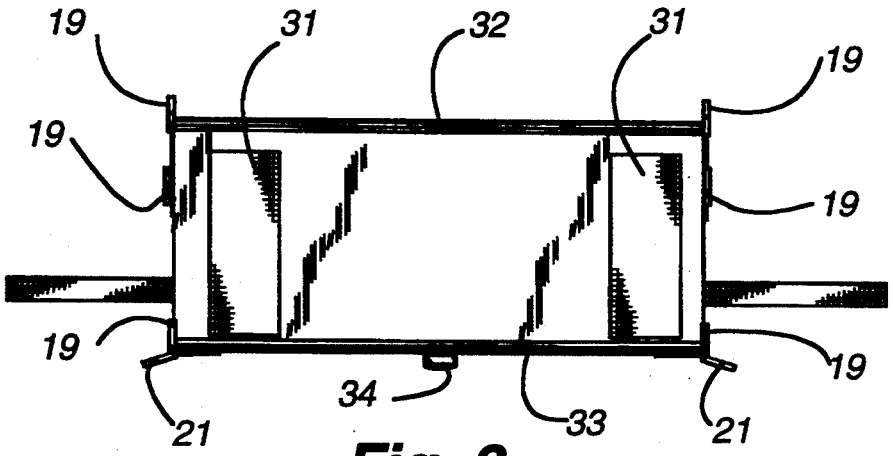
FIG. 3 is a rear end view of the wedge cushions of FIGS. 1 and 2, showing the two covered hook/loop fastener strips that are located on the rear vertical surface of these two cushions.

FIG. 1 is a front and right side perspective view of a first form of inclined wedge cushion 10 in accordance with the invention. The right vertical side wall of wedge 10 is a mirror image of the illustrated left vertical side wall. The vertical back side wall of wedge 10 is shown in FIG. 3.

While the invention is not to be limited thereto, wedge 10 and the other cushions of the invention (to be described) are preferably formed of a high-density urethane foam inner core that is covered by an anti- microbial treated nylon fabric that is waterproof, breathable and allows the inner core to bend under an applied force. Further, the fabric is washable and autoclavable.

Cushion 10 includes four top-disposed nylon straps 11, 12, 13 and 14, strap 14 of which is shown in its unfolded position. Straps 11–14 extend generally normal to the central axis 27 of cushion 10. The two free ends of each strap 11–14 terminate in a hook/loop fastener 15 of the well-known Velcro brand type. Straps 11–14, when folded, do not interfere with support of the body of an individual. When unfolded, straps 11–14 are selectively used to wrap about an individuals body (for example, the torso) to support and restrict movement of the individual.

A hook/loop fastener patch 16 is located generally in the center of each of the straps 11–14, generally in the location of central axis 27. Patches 16 are covered by the straps when the straps are in a folded condition. Patches 16 are used to selectively attach other cushions to the top surface 18 of cushion 10, as desired Patches 16 are exposed for use when a strap is unfolded, as is seen at strap 14.

Two side-disposed hook/loop fastener strips 17 are provided on the top surface 18 of cushion 10. Strips 17 are positioned generally equal distances from central axis 27, and extend generally parallel thereto. As shown in FIG. 1, strips 17 are inoperative as they are covered in the manner shown in FIGS. 13 and 14.

Figure 2:
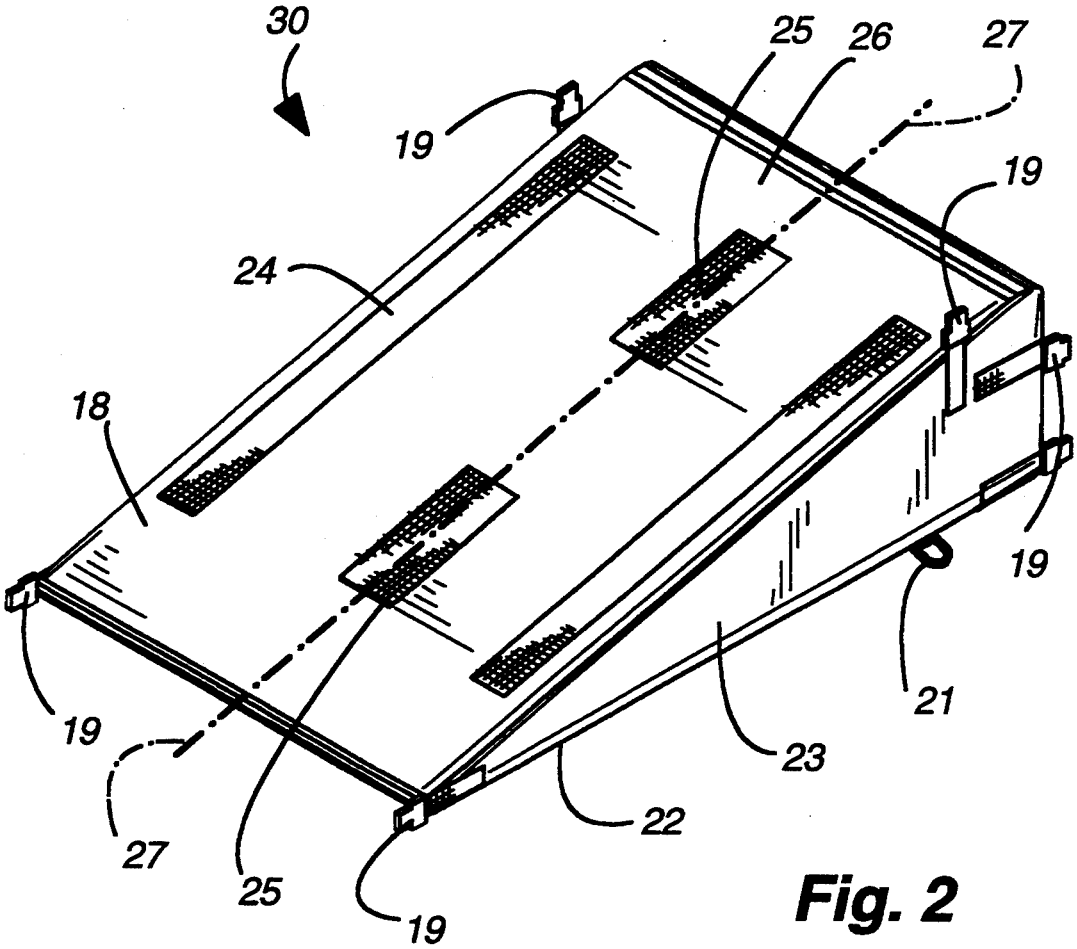
FIG. 2 is a front and right side perspective view of a second form of inclined wedge cushion in accordance with the invention, the cushion having two covered and side-disposed disposed hook/loop fastener strips on the top surface thereof, two end-disposed and centered hook/loop fastener patches on the top surface of the cushion, three interconnecting hooks located on each of the vertical sides of the cushion, and an interconnection ring located on the bottom edge surface of each side wall of the cushion.

Wedge-shaped cross-section cushion 10, as well as cushion 30 of FIG. 2, have a horizontal width that generally exceeds the horizontal width of an individual to be supported on surface 18. Surface 18 includes upward-extending central axis 27. Surface 18 includes a bottom end or edge 28 that is located adjacent to a generally horizontal surface or floor (not shown) on which cushion 10, 30 is supported. Edge 28 extends generally normal to central axis 27. Surface 18 also has a top end or edge 29 that is located a vertical distance above this surface. Top end 29 extends generally normal to central axis 27.

Three interconnecting hooks 19 are located on each of the two vertical sides 20 of cushion 10. Hooks 19 are side-release, male/female, deformable plastic buckles. Side-release male/female buckles 19 cooperate with mating buckles on other cushions to facilitate the coupling of such other cushions to cushion 10. The buckles are attached by nylon webbing stitched to the cushions. Other types of buckles or hooks could be used, the webbing could be adjustable in length where it attaches to the buckle.

Each vertical side wall 20 of cushion 10 includes a plastic D ring 21 that is mounted on the bottom edge surface 22 of each side wall. Ring 21 comprises a cushion interconnecting means for cushion 10, in that ring 21 is adapted to receive a belt (not shown), which belt threads through similar rings on other cushions, thereby facilitating the stable coupling of such other cushions to cushion 10.

FIG. 2 is a front and right side perspective view of a cushion 30, which is a second form of inclined wedge cushion 10 in FIG. 1, in accordance with the invention. Cushion 30 includes two side- disposed hook/loop fastener strips 24 on the top surface 18 thereof. Strips 24 extend generally normal to central axis 27. Strips 24 are shown in a covered state, much as strips 17 are shown in FIG. 1. Two end-disposed and centered hook/loop fastener patches 25 are provide on the top surface 26 of cushion 30. As shown, patches 25 are covered. Three interconnecting hooks 19 are again located on each of the vertical sides 23 of cushion 30. A cushion interconnecting D ring 21 is again located on the bottom edge surface 22 of each side wall 23 of cushion 30.

While not critical to the invention, the vertical side walls of cushions 10 and 30 lie in parallel planes and comprise a right triangle.

FIG. 3 is a rear end view of the wedge cushions of FIGS. 1 and 2, showing two covered hook/loop fastener strips 31 that are located on the rear vertical surface 32 of cushions 10 and 30. Also shown in FIG. 3 is a plastic or metal D ring 34 that is mounted on the bottom edge 33 of vertical surface 32. Rings 34 are of use when carrying or storing cushions 10, 30 as by hanging the cushions, or as by interconnecting the cushions one to the other.

The inclined wedge cushions 10 and 30 of FIGS. 1 and 2, as well as other cushions in accordance with the invention, can be made in a variety of sizes. While not critical to the invention, exemplary sizes for the wedge cushions of FIGS. 1 and 2 are about 23 inches wide, (large size) about 37 inch incline by about 10 inches high, (medium size) about 25 inch incline by about 10 inches high, and (small size) about 16 inch incline by about 6 inches high.

Figure 18:
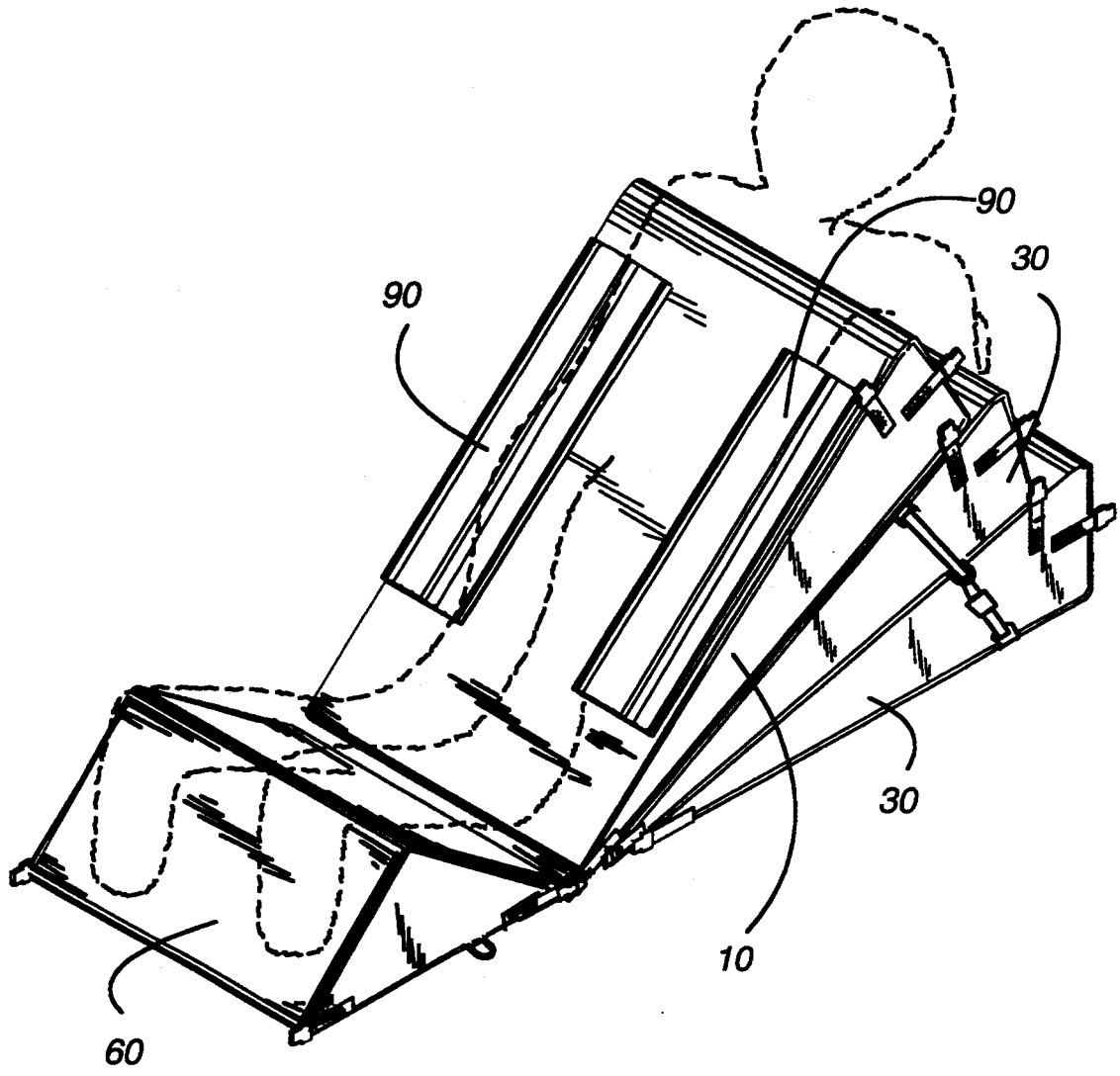
FIG. 18 is a view similar to FIG. 15 wherein two additional wedge cushions are provided.

FIGS. 15, 17 and 18 show three exemplary uses of the inclined wedge cushions of FIGS. 1 and 2. In FIGS. 17 and 18, two belts are threaded through D rings 21 in order to couple cushions 10 and 30 together, as above described. Two or more cushions 30 may be positioned under cushion 10 to change the incline of cushion 10. Further, cushion 30 may be positioned to a greater or lesser extent under cushion 10 or another cushion 30 to change angle of incline any desired amount.

Figure 4:
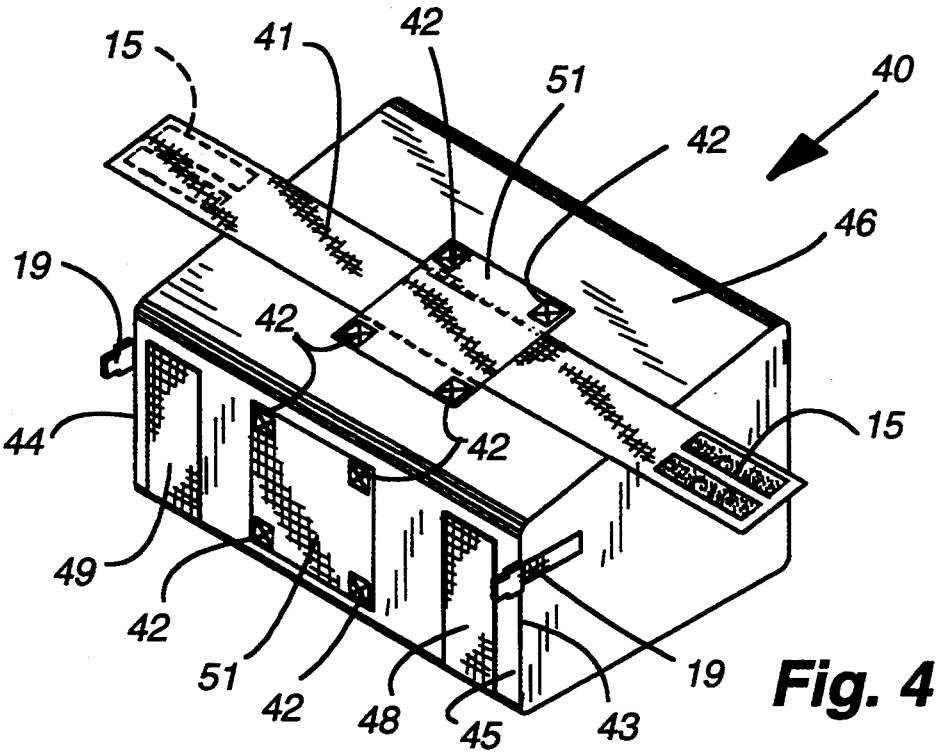
FIG. 4 is a front and right side perspective view of a multi-purpose block cushion in accordance with the invention, the cushion having a removable fabric strap on the top surface thereof, two covered hook/loop fastener strips on the front vertical surface of the cushion, and an interconnecting hook located on the front vertical edge of each of the vertical sides of the cushion.

FIG. 4 is a front and right side perspective view of a multi-purpose block cushion 40 in accordance with the invention. Cushion 40, as shown in FIG. 4, includes a removable nylon strap 41 sliding under slot patch 51 that is mounted on the top generally horizontal surface or front vertical surface 45 of cushion 40. Strap 41 is similar in construction to straps 11–14 of FIG. 1 and includes hook/loop fastening means 15 on the two ends thereof.

Two covered hook/loop fastener strips 48 and 49 are mounted on the front vertical surface 45 of cushion 40, as well as on the rear vertical surface (not shown) of cushion 40. The rear surface of cushion 40 is generally identical to front surface 45, with the exception that the rear surface is somewhat larger in vertical height. Four stitching patches 42 hold the slot patch 51 in place on the front vertical surface 45 or top surface of cushion 40. An interconnecting hook 19 is located on the front vertical edge 43,44 of each of the vertical sides of cushion 40. While not critical to the invention, the front and rear walls of cushion 40 are generally parallel, and the two side walls of cushion 40 are generally parallel.

In an embodiment of the invention, cushion 40 was about 23 inches wide, about 16 inches in horizontal length, the height of front vertical surface or wall 45 was about 10 inches, and the height of the cushions rear vertical surface or wall was about 13 inches.

Figure 5:
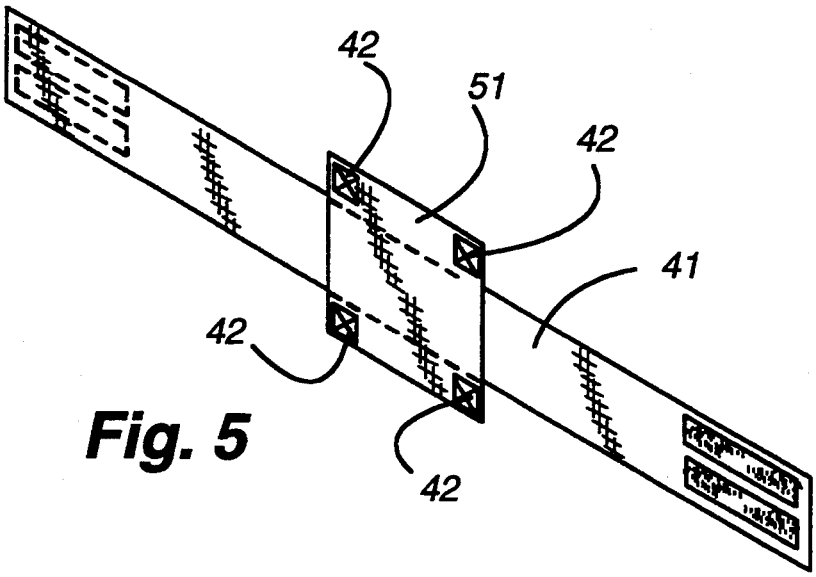
FIGS. 5 and 6 show two alternate arrangements whereby the removable strap of FIG. 4 may be threaded through the fabric slot on the front vertical surface of the block cushion of FIG. 4, FIG. 5 showing a generally horizontal strap orientation and FIG. 6 showing a vertical strap orientation.
Figure 6:
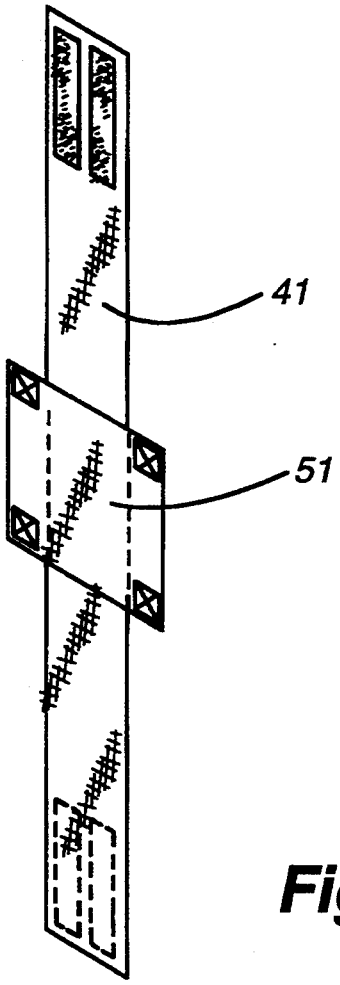

FIGS. 5 and 6 show two alternate arrangements whereby the removable strap of FIG. 4 may be threaded through a slot that is formed by nylon fabric patch 51. As shown in FIG. 5, patch 51 includes four stitching squares 42 that function to secure patch 51 to the top surface, the front surface, or the rear surface of block 40. For example, FIG. 5 shows a generally horizontal strap orientation, and FIG. 6 shows a vertical strap orientation relative to the front surface 45 of block 40. In a similar manner, strap 41, or perhaps a second similar strap, can be threaded through a patch 51 that is secured to the top surface and/or to the back surface of block 40.

Figure 22:
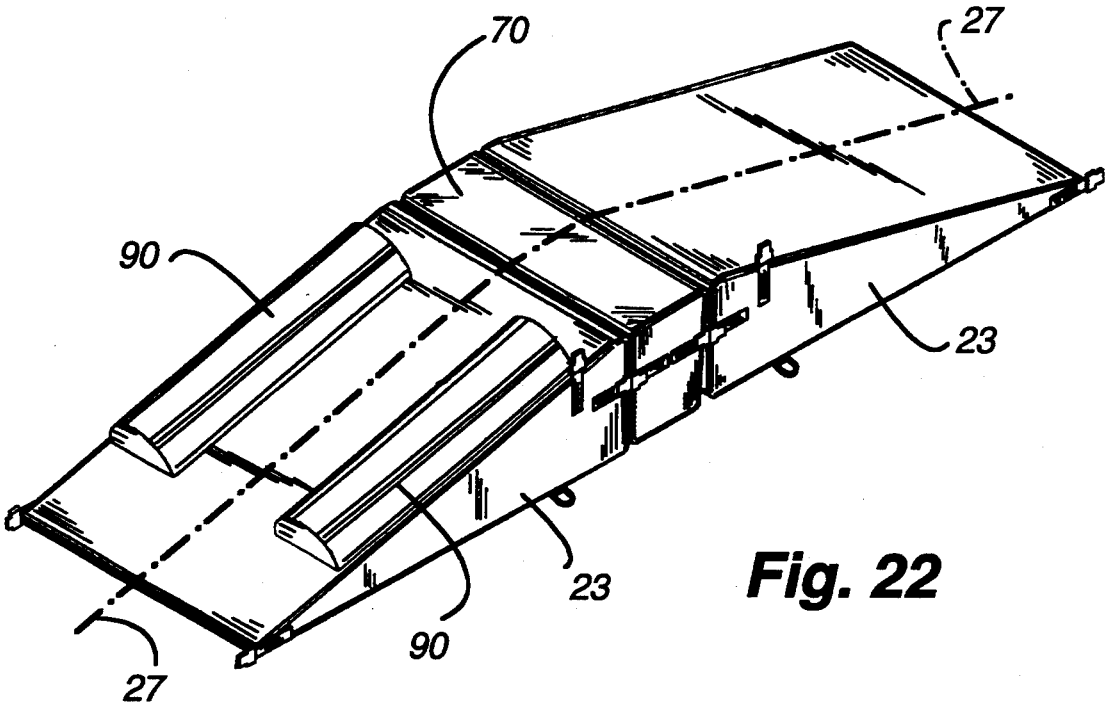
FIG. 22 is a front and right side perspective view of various cushions that are interconnected to provide a Trendelenburg position for a prone or supine user, this arrangement also being usable for cardio pulmonary therapy.
Figure 23:
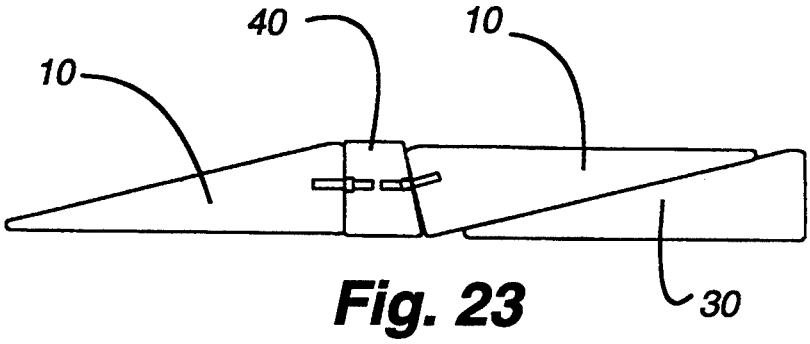
FIG. 23 is a right side view of the arrangement of FIG. 22 wherein and additional wedge cushion is used to elevate the head or feet of a user.
Figure 24:
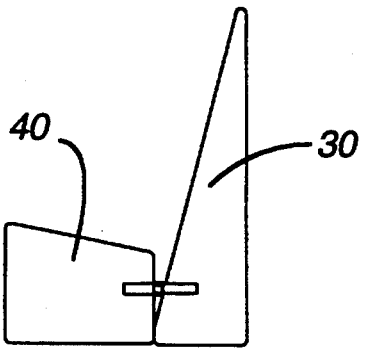
FIGS. 24 and 25 are right side views of various cushions that are interconnected and arranged to provide for seating therapy of a user.
Figure 25:
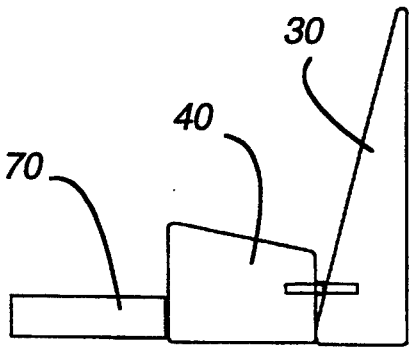
Figure 26:
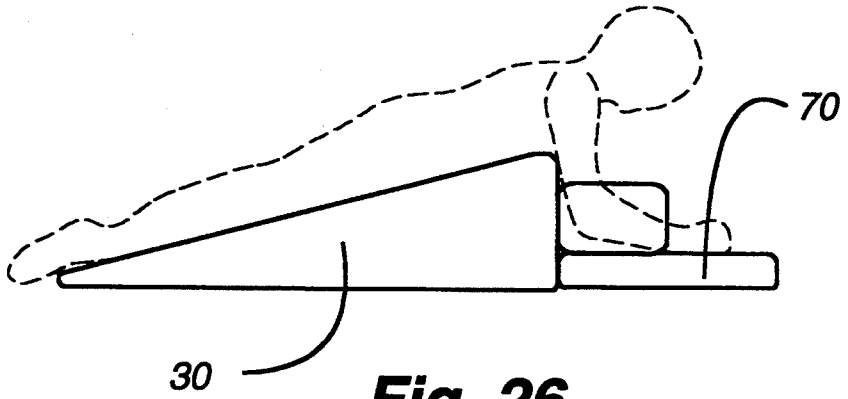
FIGS. 26, 27 and 28 show cushion arrangements in accordance with the invention adapted to facilitate prone therapy of an individual using an inclined wedge cushion, a vertically thin block cushion and a short block cushion that allows placement of the arms adjacent the vertical side walls of the short block cushion, FIG. 27 additionally showing the use of a double inclined cushion, and FIG. 28 additionally showing the use of a half-cylinder cushion.
Figure 27:
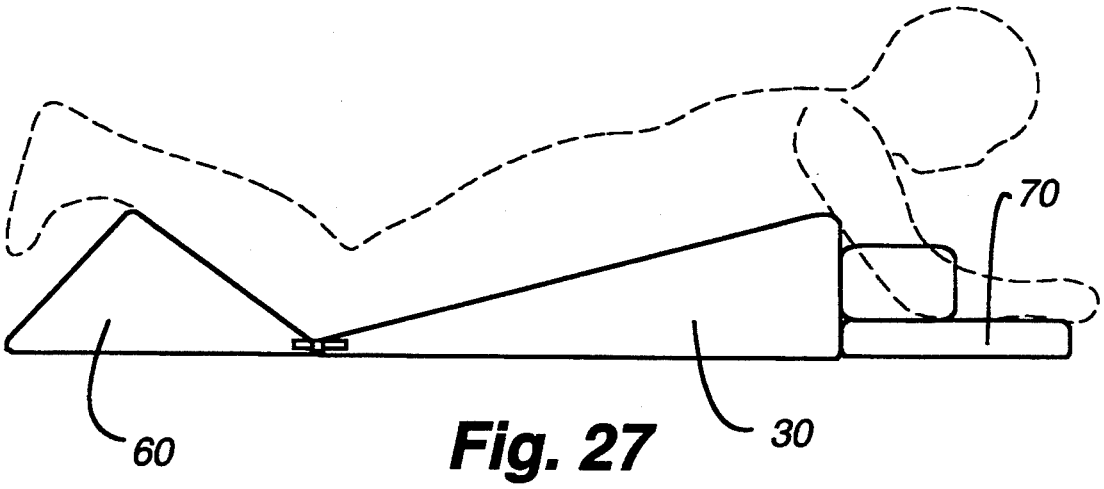
Figure 28:
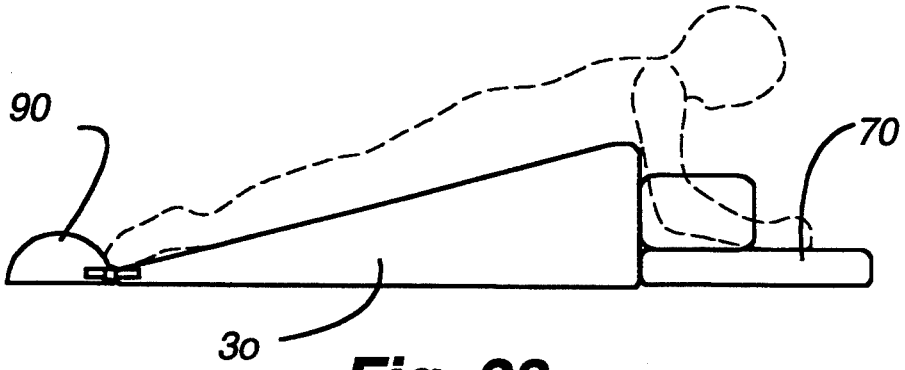
Figure 29:
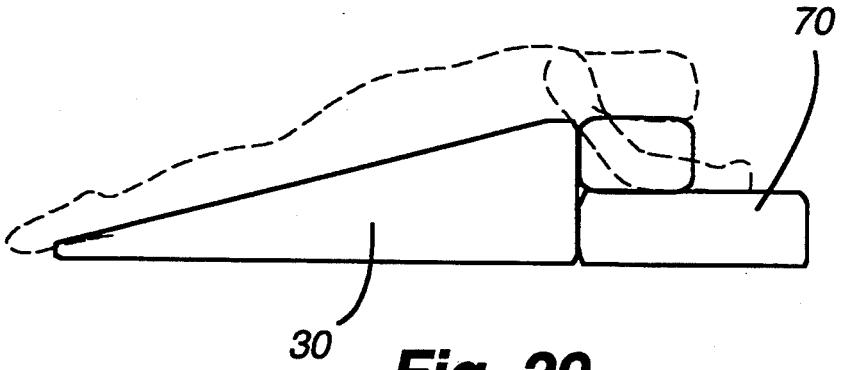
Figure 30:
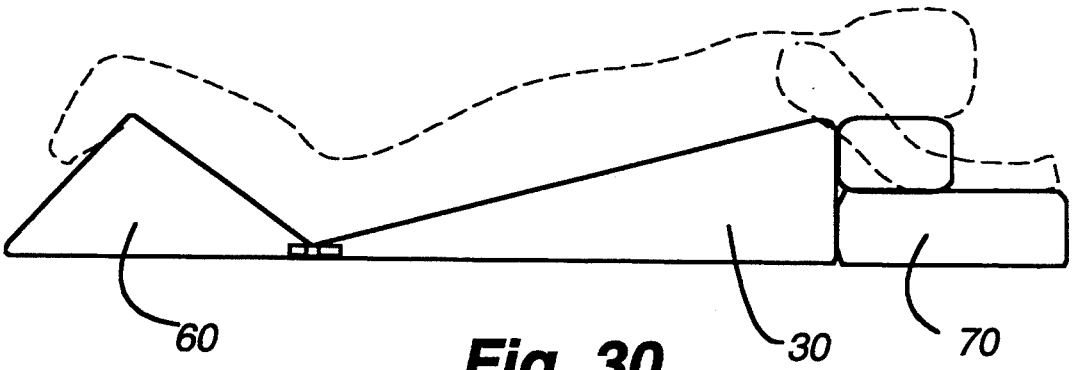
Figure 31:
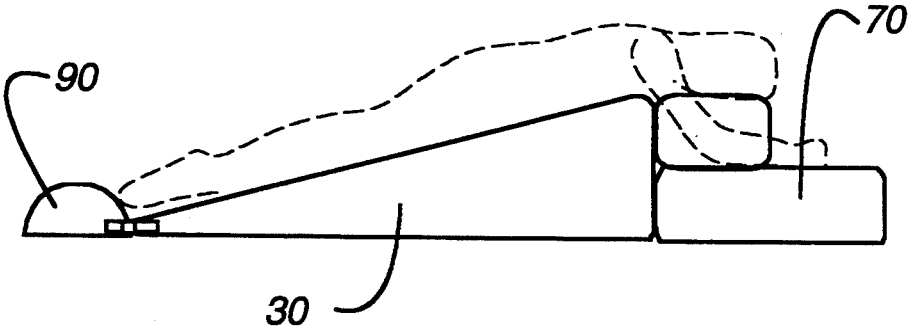
Figure 34:
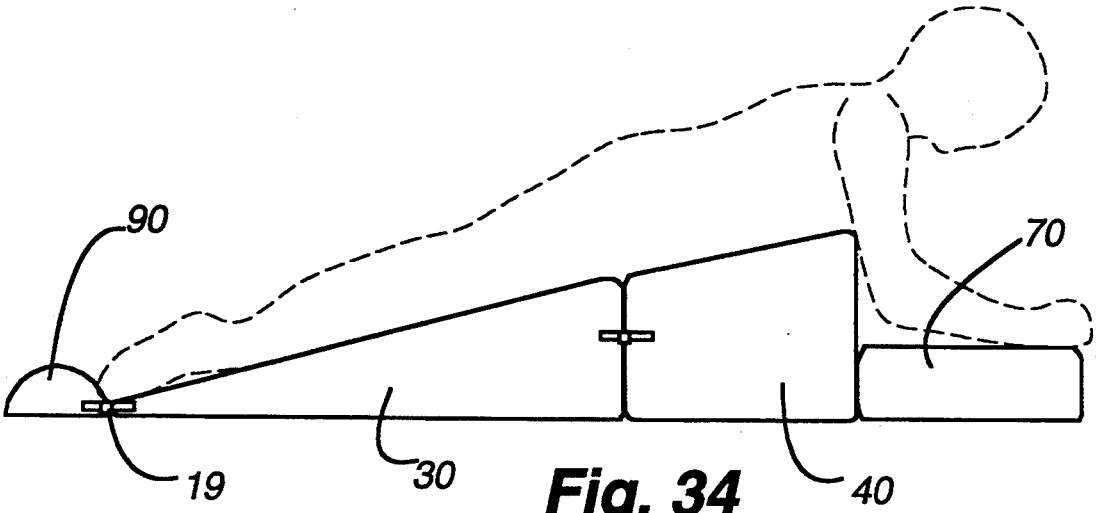
FIG. 34 shows a cushion arrangement similar to FIG. 33 wherein a multi-purpose block cushion has been added.
Figure 35:
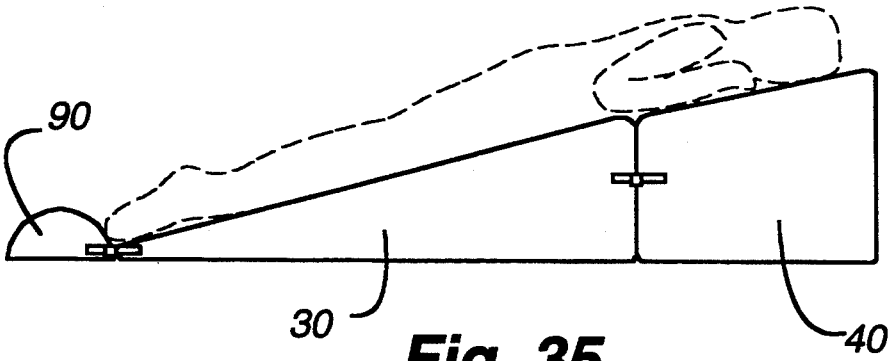
FIG. 35 shows a cushion arrangement similar to FIG. 34 wherein the vertically thin block cushion of FIG. 34 is eliminated.
Figure 36:
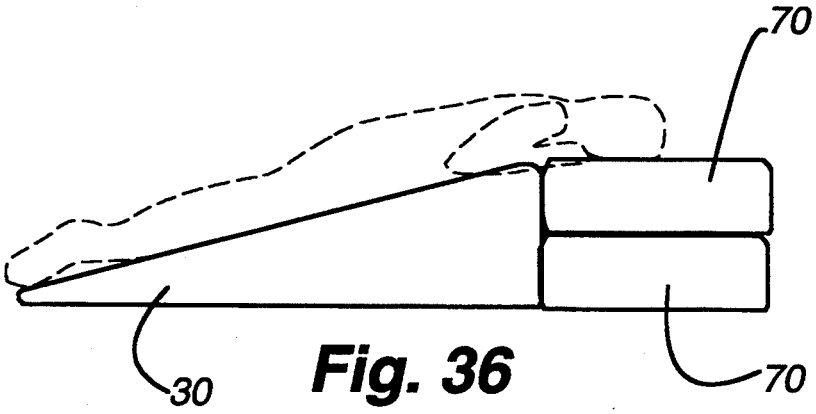
FIG. 36 shows a cushion arrangement similar to FIGS. 26 and 29 using an inclined wedge cushion and two block cushions.
Figure 37:
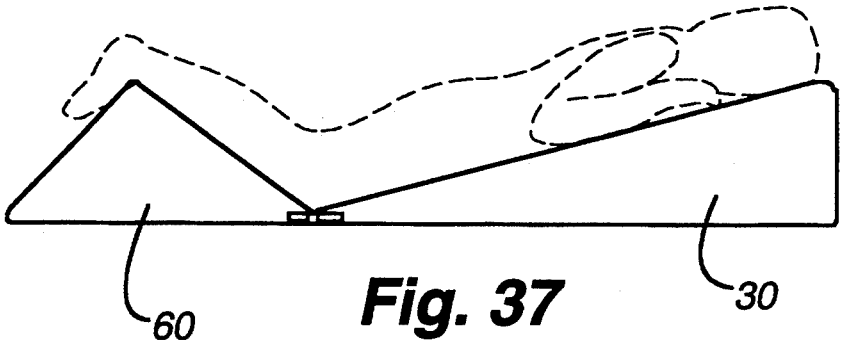
FIG. 37 shows a cushion arrangement similar to FIGS. 27 and 30 using only an inclined wedge cushion and a double incline cushion.
Figure 38:
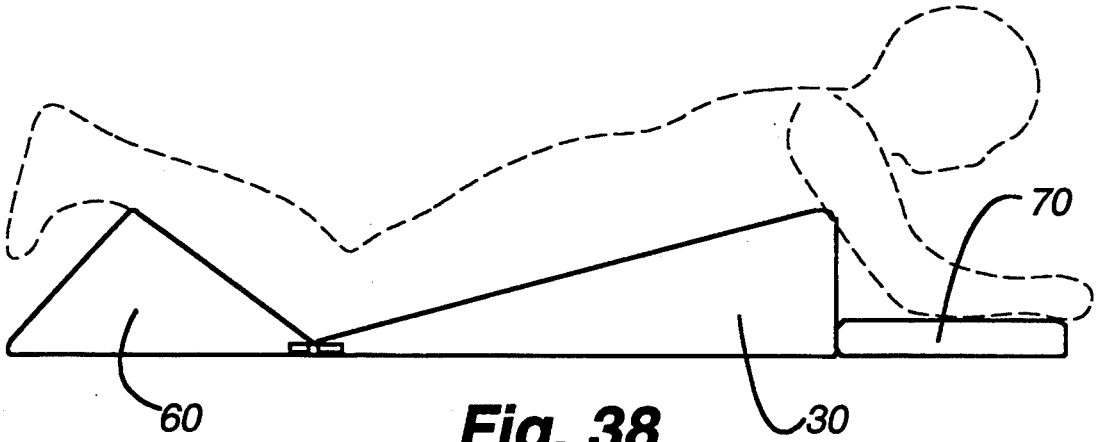
FIG. 38 shows a cushion arrangement similar to FIG. 37 wherein a vertically thin block cushion has been added.
Figure 39:
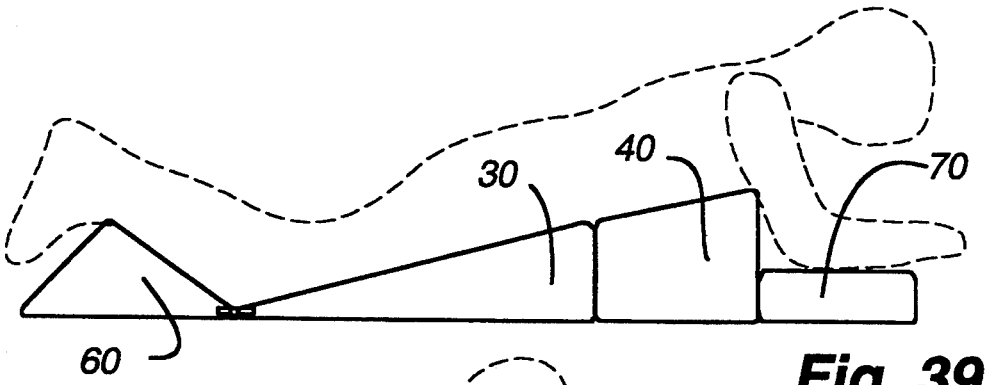
FIG. 39 shows a cushion arrangement similar to FIG. 38 wherein a multi-purpose block cushion has been added.
Figure 40:
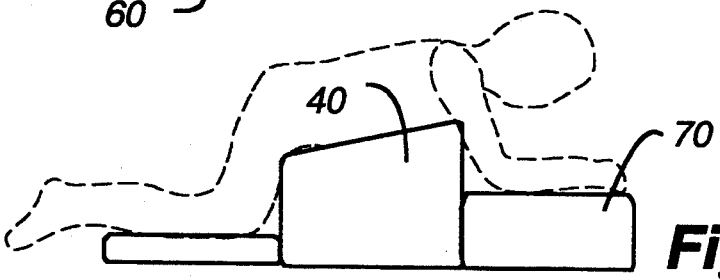
FIGS. 40, 41 and 42 show the use of a multi-purpose block cushion along with other block cushions to facilitate side support or sidelying of an individual.
Figure 41:
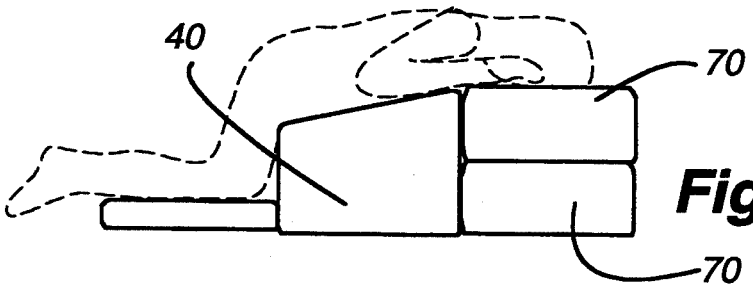
Figure 42:
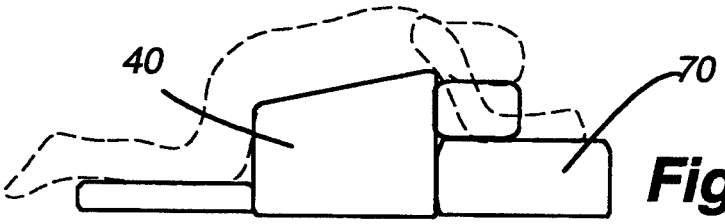
Figure 43:
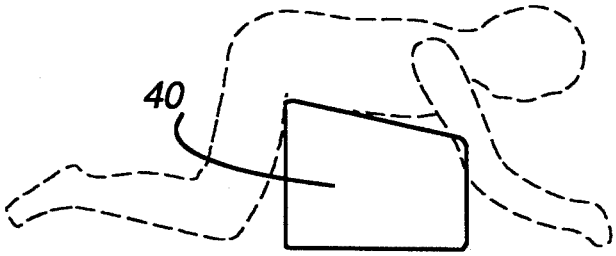
FIGS. 43 and 44 show the use of a multi-purpose block cushion to facilitate four-point support of an individual.
Figure 44:
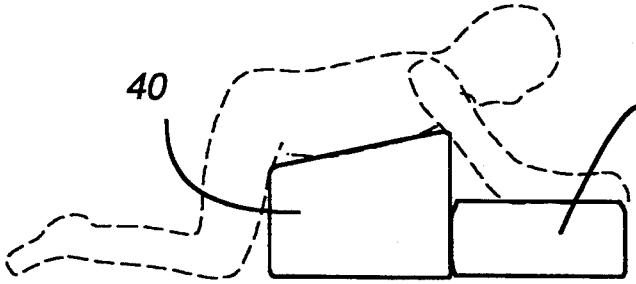
Figure 45:
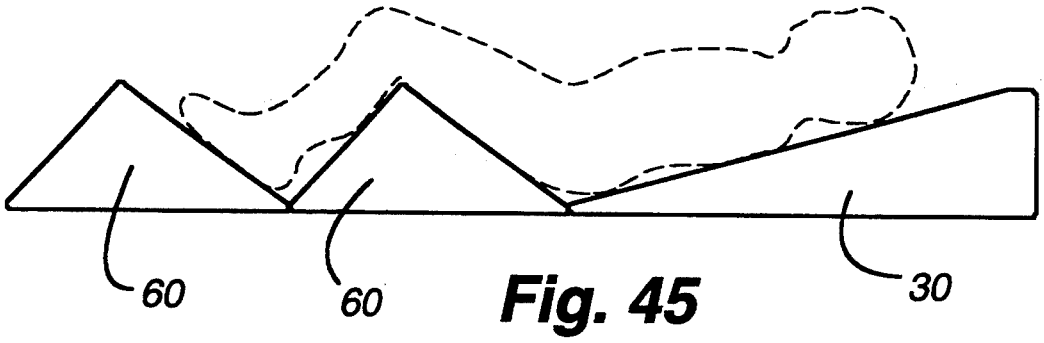
FIGS. 45, 46, 47, and 48 show cushion arrangements in accordance with the invention, wherein an individual is supported in the supine position by the use of one or more inclined wedge cushions and two double inclined cushions.
Figure 46:
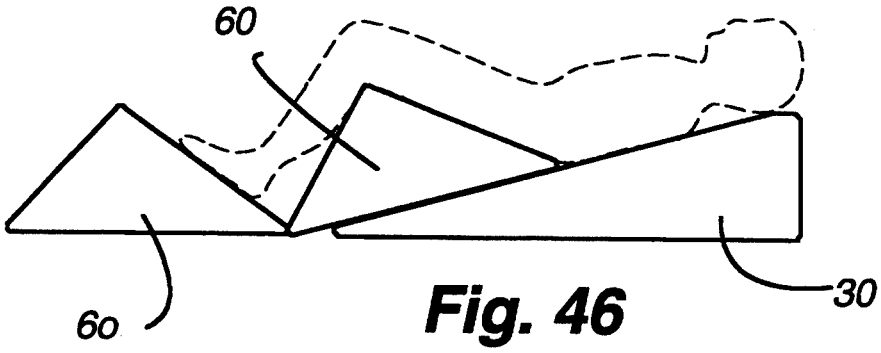
Figure 47:
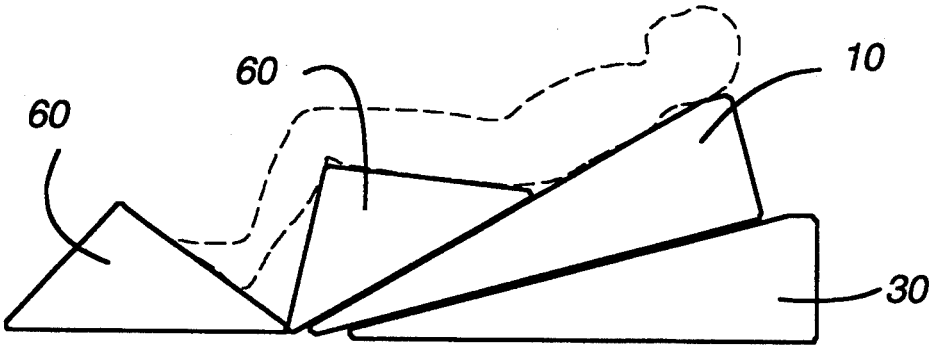
Figure 48:
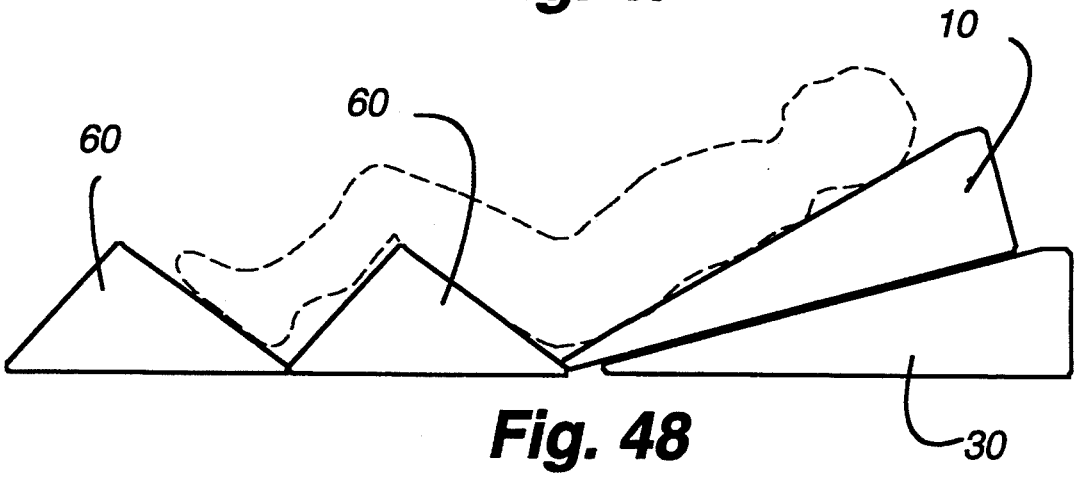
Figure 49:
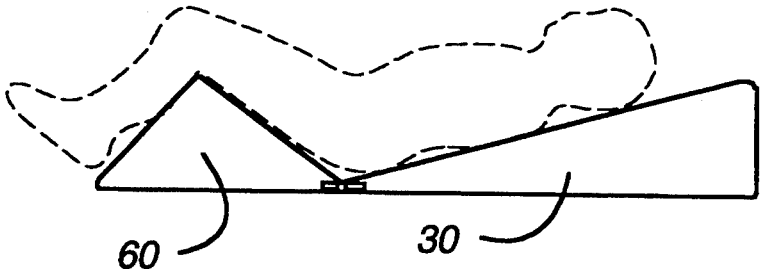
FIGS. 49, 50 and 51 show cushion arrangements in accordance with the invention, wherein an individual is supported in the supine position by the use of one or more inclined wedge cushions and one double inclined cushion, FIG. 51 showing the additional use of a multi-purpose block cushion.
Figure 50:
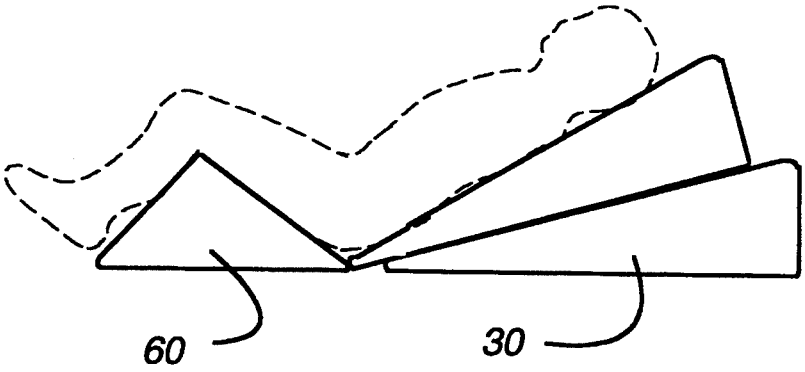
Figure 51:
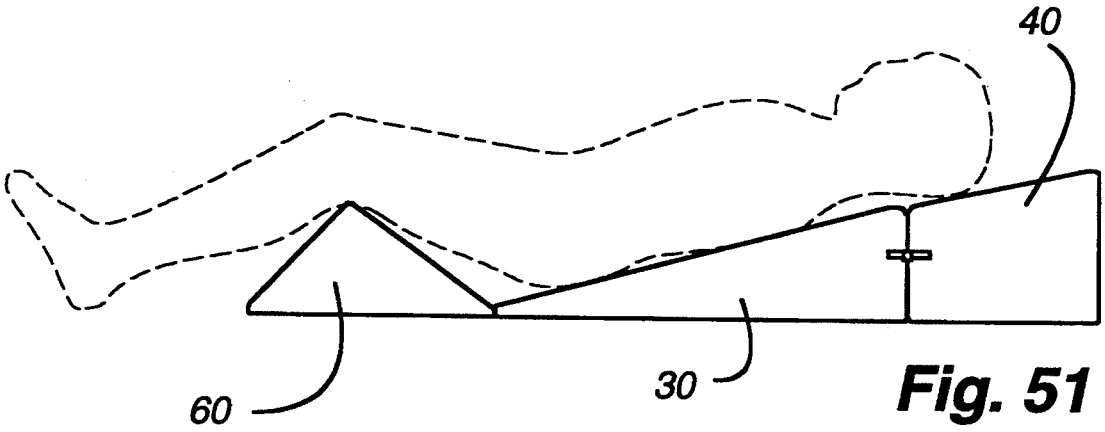
Figure 52:
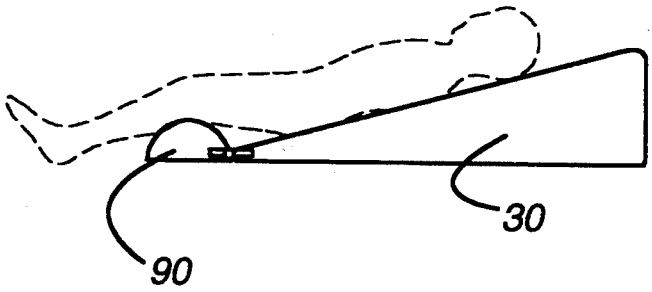
FIGS. 52 and 53 show cushion arrangements in accordance with the invention, wherein an individual is supported in the supine position by the use of an inclined wedge cushion and one-half cylinder roll cushion, FIG. 51 showing the additional use of a multi-purpose block cushion.
Figure 53:
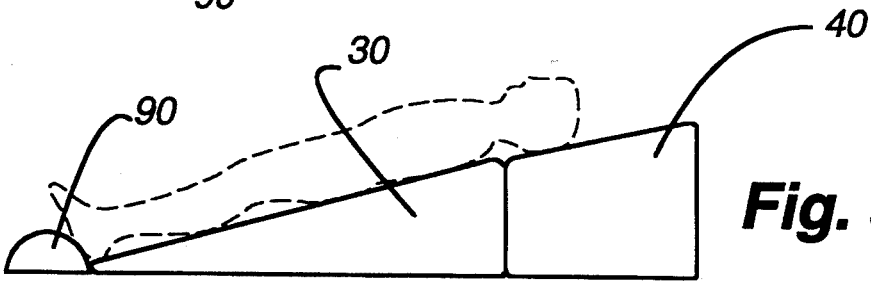
Figure 54:
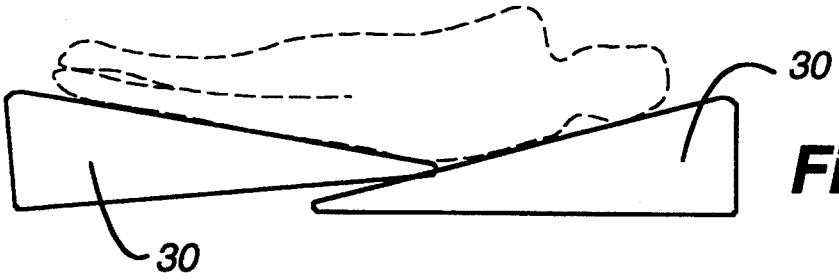
FIGS. 54 and 55 show cushion arrangements in accordance with the invention, wherein an individual is supported for CPT and Trendelenburg therapy by the use of two inclined wedge cushions, FIG. 55 showing the additional use of two block cushions in point-to-point elevation.
Figure 55:
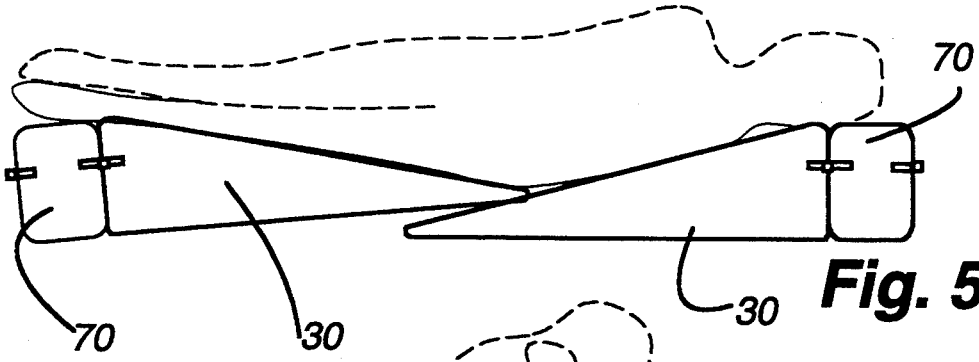
Figure 56:
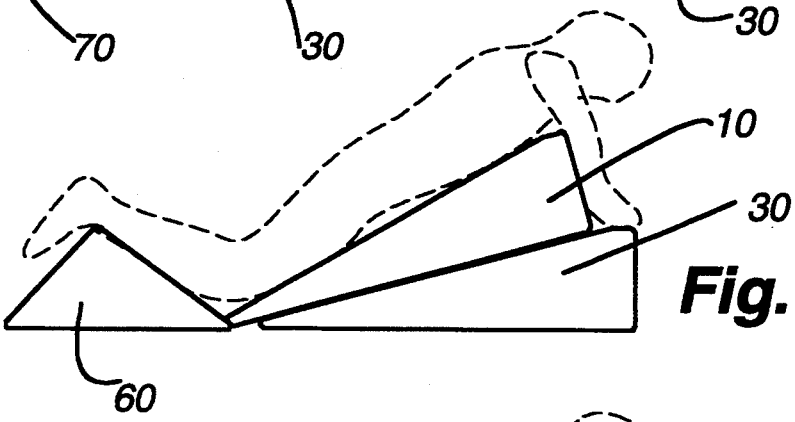
FIGS. 56, 57 and 58 show the use of various cushions in accordance with the invention to support an individual in a prone-kneeling position.
Figure 57:
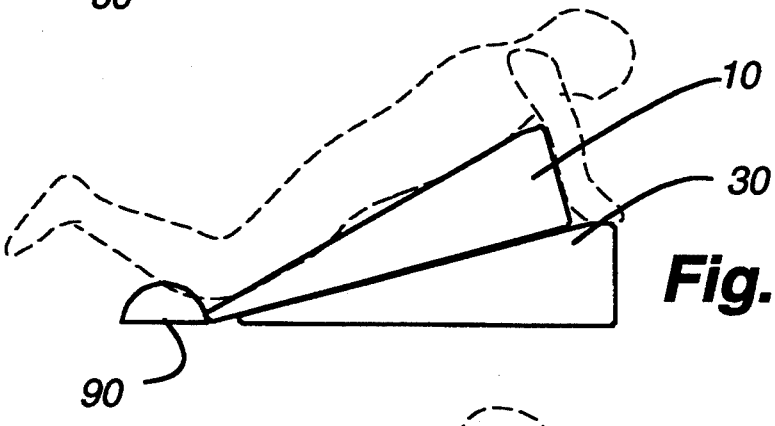
Figure 58:
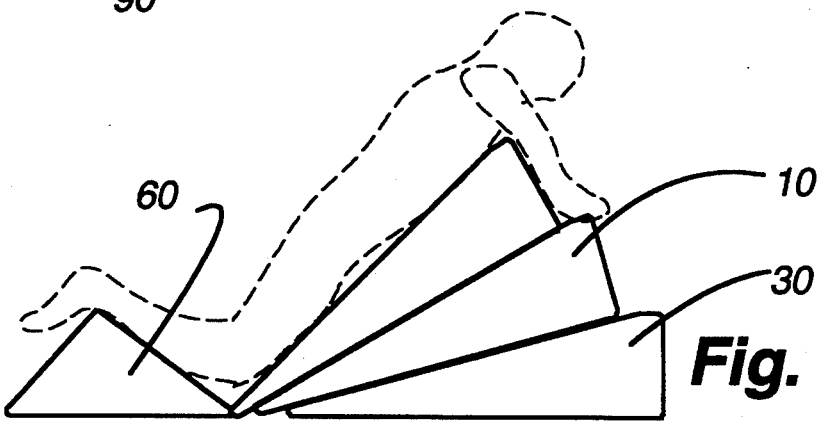
Figure 59:
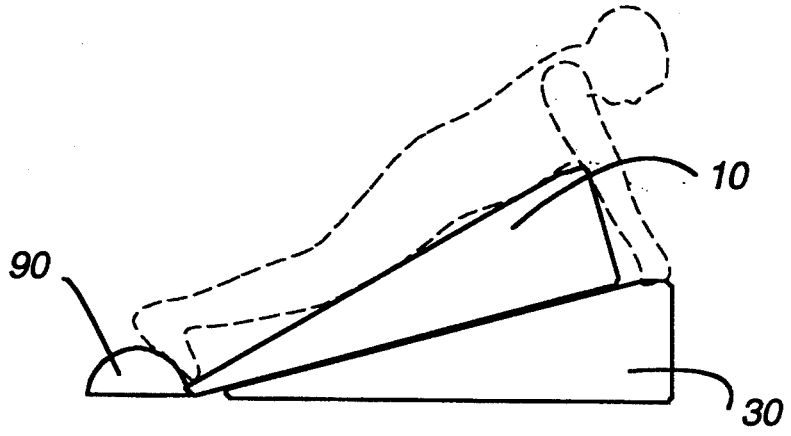
FIGS. 59, 60 and 61 show the use of various cushions in accordance with the invention to support an individual in a prone-standing position.
Figure 60:
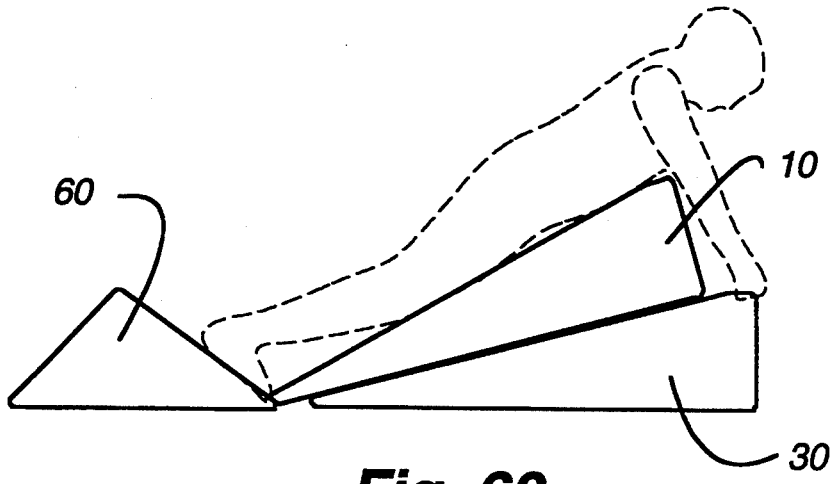
Figure 61:
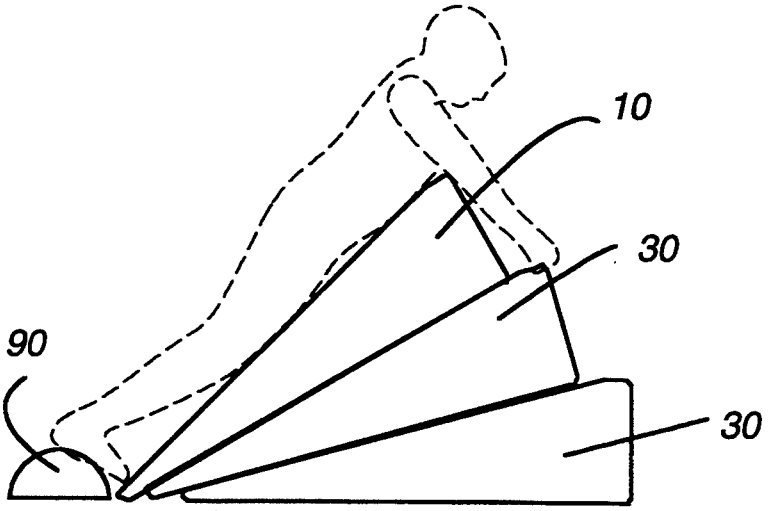

FIGS. 22 and 23 show cushion arrangements including one block cushion 40 interconnected to other cushions to provide a Trendelenburg position for a user in a prone or supine position, this arrangement also being usable for Cardio Pulmonary Therapy (CPT). FIGS. 24 and 25 show two exemplary uses of multi-purpose block cushions 40 wherein cushions are interconnected and arranged to provide for seating therapy of a user. FIGS. 34, 35 and 39 show cushion arrangements wherein a multi-purpose block cushion 40 has been added to an inclined wedge cushion 10 or 30 to extend the length thereof. FIGS. 40, 41 and 42 show the use of a multi-purpose block cushion 40, along with other block cushions to facilitate side support or sidelying of an individual. In these arrangements, a vertically extending strap 41 (not shown) is provided to secure the individual to the exposed vertical surface of block 40. FIGS. 43 and 44 show the use of a multi- purpose block cushion 40 to facilitate four-point support of an individual. FIG. 51 and 53 shows cushion arrangements in accordance with the invention, wherein an individual is supported in the supine position by a multi-cushion apparatus that includes a multi-purpose block cushion 40 operating to extend the length of an inclined wedge cushion 10 or 30. FIG. 55 shows a cushion arrangement in accordance with the invention wherein an individual is supported for sidelying and rotation therapy by the use of two inclined wedge cushions 10 or 30 wherein two block cushions 70 are used to extend the length of the inclined wedge cushions. The wedge cushions are placed point-to-point. By sliding one wedge cushion under the other, the inclined wedge surfaces can be transformed into more horizontal surfaces and ultimately create a block.

Figure 7:
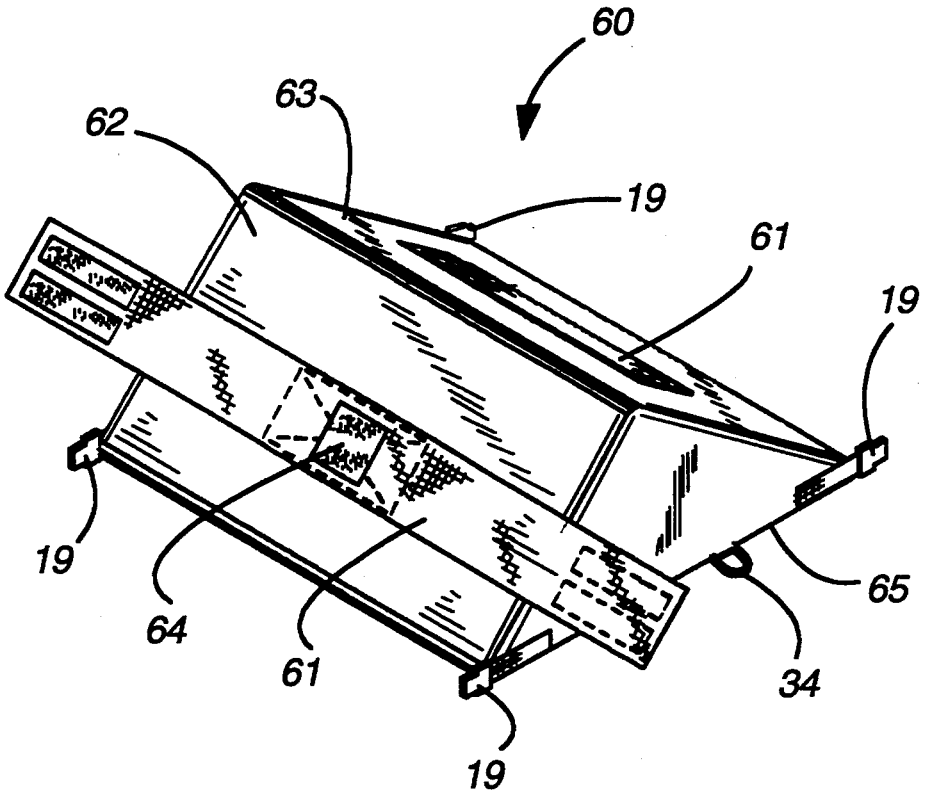
FIG. 7 is a front and right side perspective view of a double inclined cushion in accordance with the invention, the cushion having a fabric strap on both the front and rear inclined surfaces thereof, the front strap being shown in its unfolded position, a covered hook/loop fastener patch that is centered under each strap, two interconnecting hooks located adjacent to the bottom edge of each of the vertical sides of the cushion, and a carrier ring located on the bottom edge of the back side of the cushion.
Figure 8:
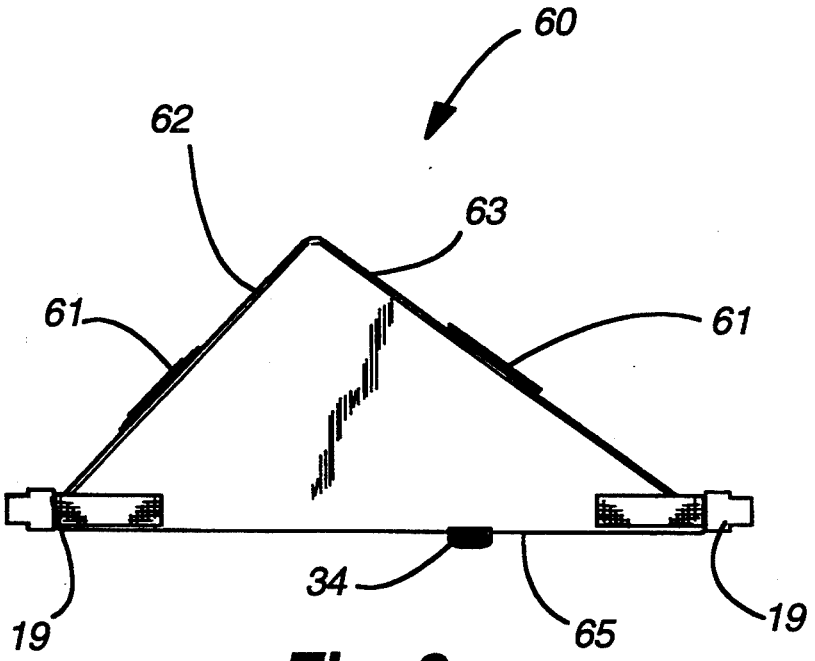
FIG. 8 is a right side view of the double inclined cushion of FIG. 7, the left side view thereof being a mirror image of FIG. 8.

FIG. 7 is a front and right side perspective view of a double inclined cushion 60 in accordance with the invention. Cushion 60 includes a nylon strap 61 on both the front and rear inclined surfaces 62 and 63 thereof. In FIG. 7, the front strap 61 is shown in its unfolded position, whereas the rear strap 61 is shown in its folded position. The two straps 61 are of the same general construction as straps 11–14 of FIG. 1. A coverable hook/loop fastener patch 64 is located under each of the straps 61, and two cushion interconnecting hooks 19 are located adjacent to the bottom edge 65 of each of the vertical sides of cushion 60. A plastic carrier ring 34 is located on the bottom edge 65 of each of the vertical sides of cushion 60. FIG. 8 is a right side view of double inclined cushion 60 of FIG. 7, the left side view thereof being a mirror image of FIG. 8.

As with all cushions in accordance with the invention, they may be constructed in a variety of sizes. Exemplary double inclined cushions 60 are generally 23 inches wide. Exemplary inclined lengths are 7 and 9 inches with a 6 inch height, two 22 inch inclines with a 10 inch height, and 12 and 14 inch inclines with a 10 inch height.

Double inclined cushions 60 are of general utility, as seen in FIGS. 15, 17–19, 27, 30, 37–39, 45–51, 56, 58 and 60.

Figure 9:
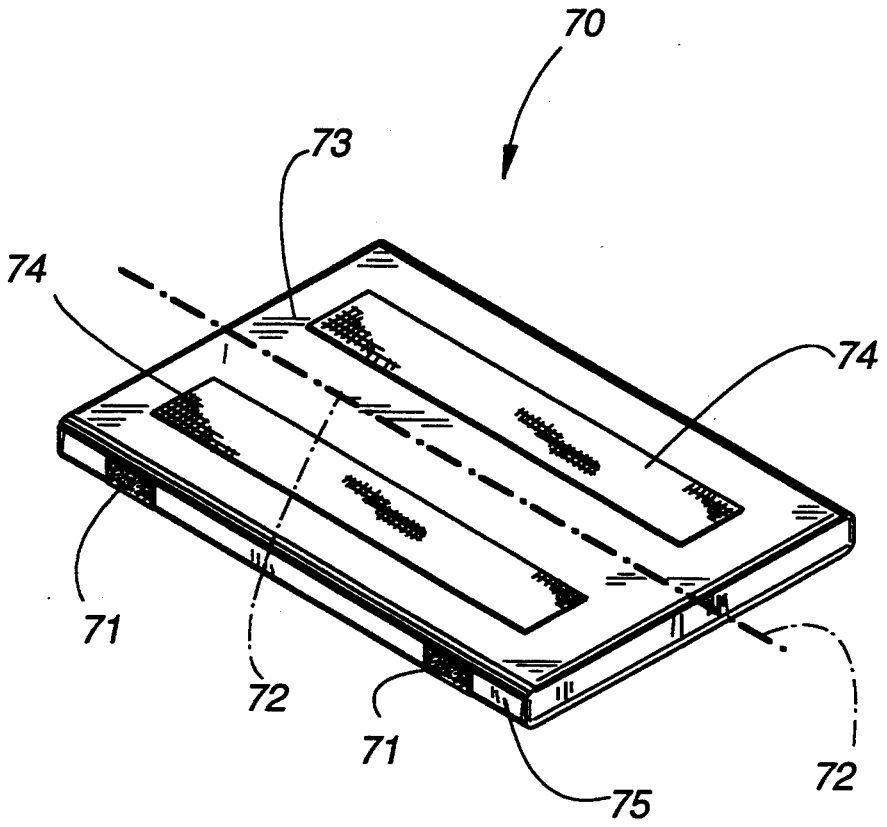
FIG. 9 is a front and right side perspective view of a vertically thin block cushion in accordance with the invention, the cushion having two covered hook/loop fastener patches on both the front and the rear vertical surfaces thereof.

FIG. 9 is a front and right side perspective view of a vertically thin block cushion 70 in accordance with the invention. Cushion 70 is formed so that all opposite surfaces are generally parallel. The cushion has two covered hook/loop fastener patches 71 on the front vertical surface 72 and on the rear vertical surface thereof. The rear surface is identical in construction to front surface 72. While the size of block cushions 70 is not critical, in an embodiment of the invention, such cushions were about 23 inches wide, about 16 inches in length, and from about 2½ to about 5 inches high. FIGS. 20, 21, 25–31, 33, 34, 36, and 38–44 show various uses of block cushions 70 of differing vertical heights to form therapeutic cushion arrangements.

Cushion 70 has opposite vertical side surfaces that are generally parallel, a horizontal top surface 73, and a horizontal bottom surface. Cushion 70 has a horizontally extending central axis 72 that extends generally normal to front side 75. The horizontal width of top surface 73, as measured normal to central axis 72, exceeds an individual's horizontal width. A pair of generally parallel hook/loop fastener strips 74 with folding covers may be mounted on top surface 73, spaced apart a distance exceeding an individual's horizontal width. Strips 73 extend generally parallel to central axis 72.

Figure 10:
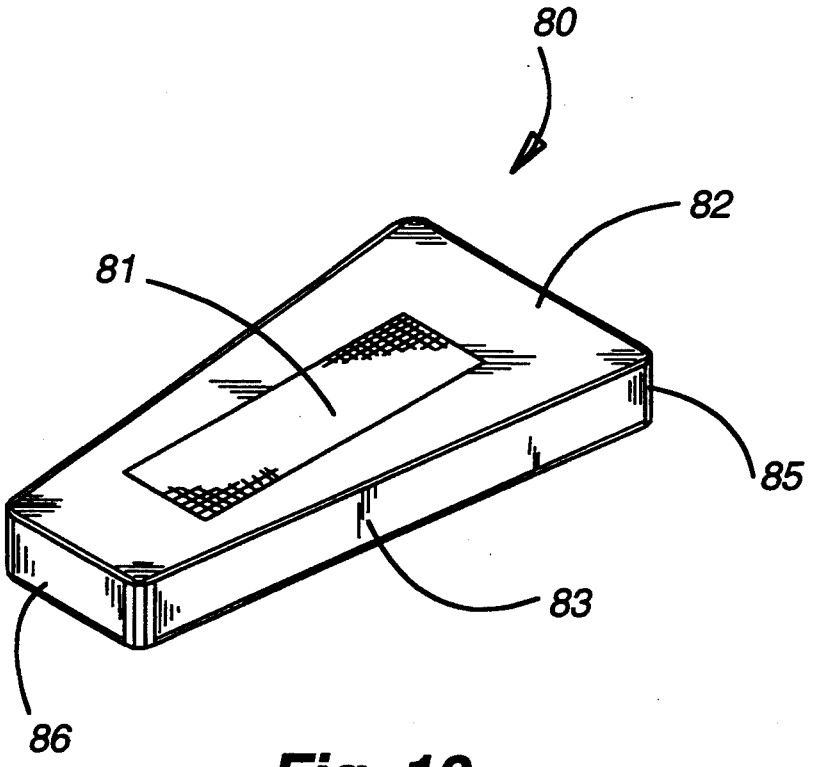
FIG. 10 is a front and right side perspective view of an abductor block cushion in accordance with the invention, the cushion having a covered hook/loop fastener patch generally centered on the top surface thereof.
Figure 11:
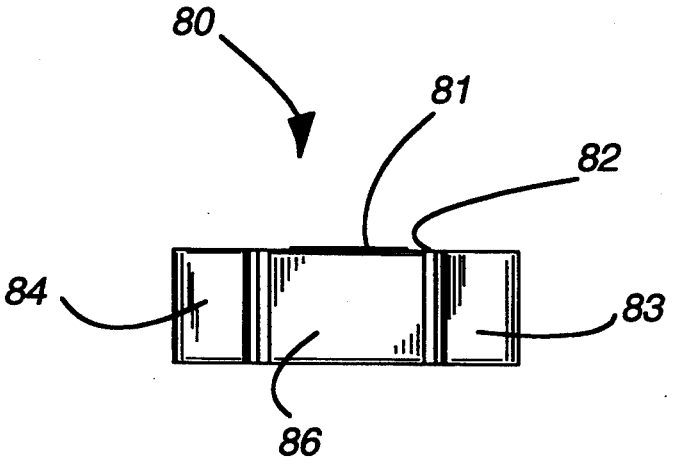
FIG. 11 is a front view of the abductor block cushion of FIG. 10.

FIG. 10 is a front and right side perspective view of an abductor block cushion 80 in accordance with the invention. Cushion 80 is provided with a covered hook/loop fastener patch 81 that is generally centered on the top surface 82 thereof. FIG. 11 is a front view of abductor block cushion 80. As noted in FIG. 11, the abductor cushion is equally tapered along sides 83 and 84 from the back surface 85 to front surface 86. The front surface 86 of cushion 80 is vertical and generally parallel to the back surface 85 of the cushion. An exemplary use of abductor block cushion 80 can be seen with reference to FIG. 56 wherein a block 80 would be attached to the top surface of wedge cushion 10 using the hook/loop fastener 16 associated with strap 14 (see FIG. 1), and the hook/loop fastener 81 associated with abductor block cushion 80. In this case, block 80 would be inverted so that its top surface 82 engages the top surface 18 of wedge cushion 10. In this position, abductor block 80 would extend between the legs of a user.

Abductor block 80 can be provided in a variety of sizes. For example, all abductor blocks 80 may be about 4 inches thick. Different size blocks are about 12 inches long and taper from about 2½ inches wide to about 5 inches wide, are about 22 inches long and taper from about 3 inches wide to about 6 inches wide, are about 6 inches long and taper from about 3 inches wide to about 6 inches wide, and are about 23 inches long and taper from about 5 inches wide to about 12 inches wide.

Figure 12:
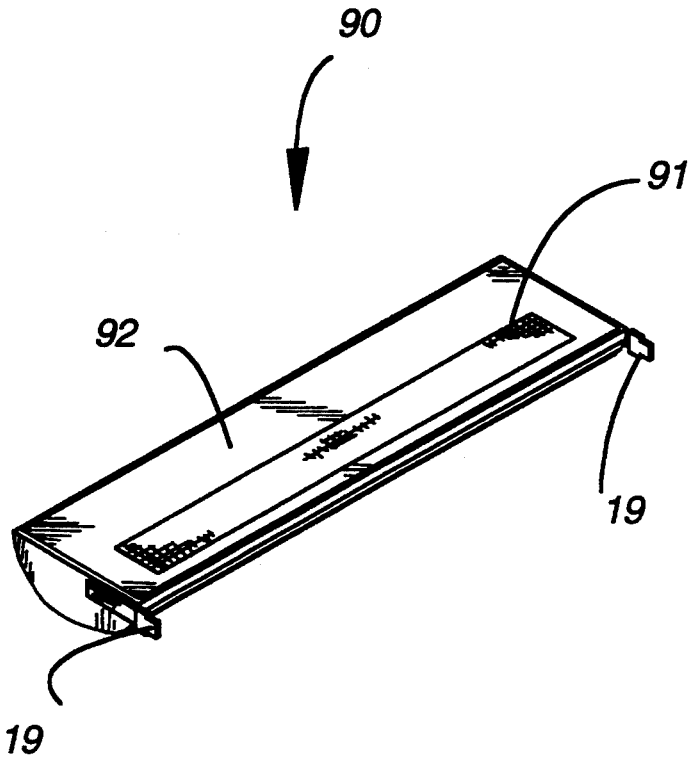
FIG. 12 is a front and bottom side perspective view of a half cylinder roll, or rail cushion in accordance with the invention, the cushion having a covered hook/loop fastener patch positioned eccentrically to one side and on bottom horizontal surface thereof, such rolls being provided in a number of different axial lengths and diameters.

FIG. 12 is a front and bottom side perspective view of a half cylinder roll or rail cushion 90A in accordance with the invention. Cushion 90A is provided with a covered hook/loop fastener patch 91 positioned to one side and on the bottom horizontal surface 92 thereof. Rolls 90A can be provided in a number of axial lengths and diameters. Exemplary sizes are 24 inches long and diameters of 4, 6, 8, 12 or 16 inches, 30 inches long with a 24 inch diameter, and 48 inches long and a 12 or 16 inch diameter.

FIG. 15 shows various cushions interconnected to provide a position of rest and relaxation as the back of a user rests thereon. In this arrangement, the two side disposed hook/loop fastener strips 17 (see FIG. 1) and the hook/loop fastener patch 91 of half roll 90A are both uncovered to facilitate the mounting of rolls 90A on the top surface of wedge cushion 10 or 30.

FIG. 16 shows how the two different size half rolls 90A and 90B of FIG. 12 are interconnected with each other and with the top surface of wedge cushion 10 or 30. The smaller half roll 90B may be positioned along the length of larger half roll 90A to adjust the position of lateral support provided to the user by the half rolls.

Figure 19:
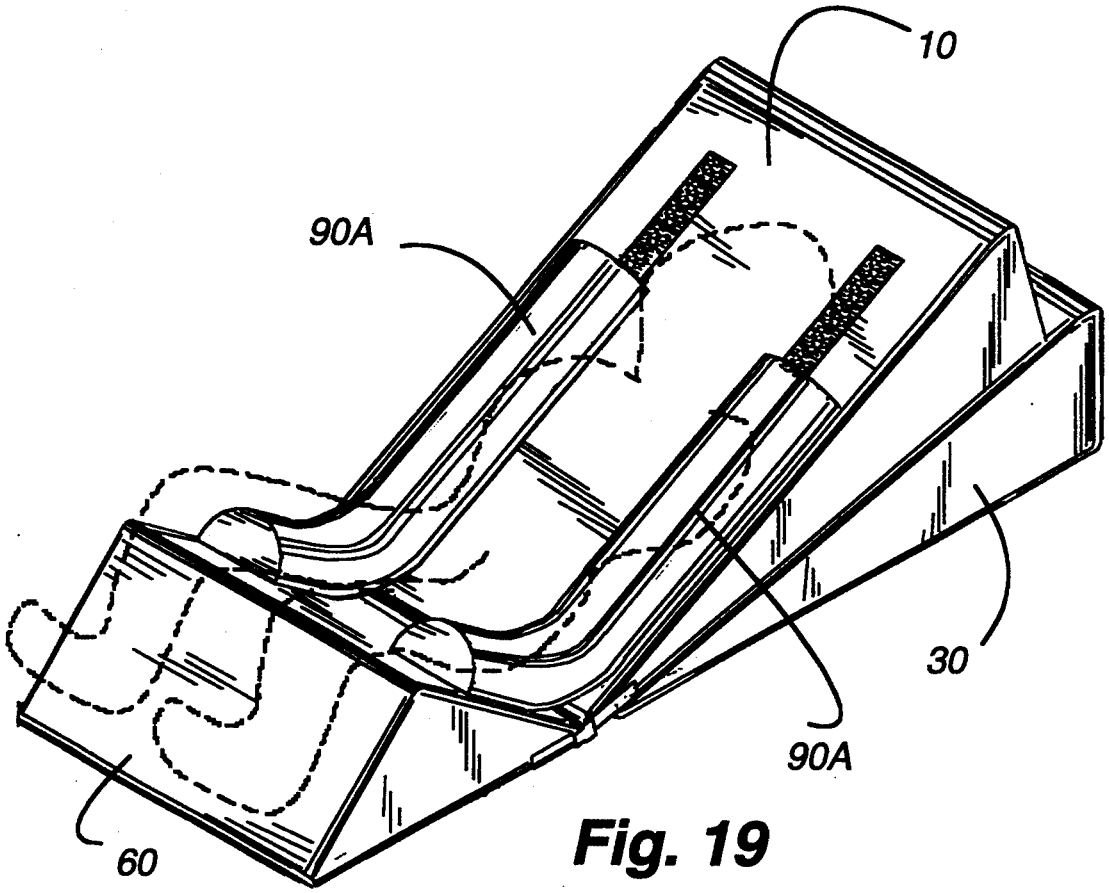
FIG. 19 is a front and right side perspective view similar to FIG. 17 wherein the two half rolls of FIG. 17 are bent and attached to the upper wedge cushion and the double inclined cushion of FIG. 17.
Figure 20:
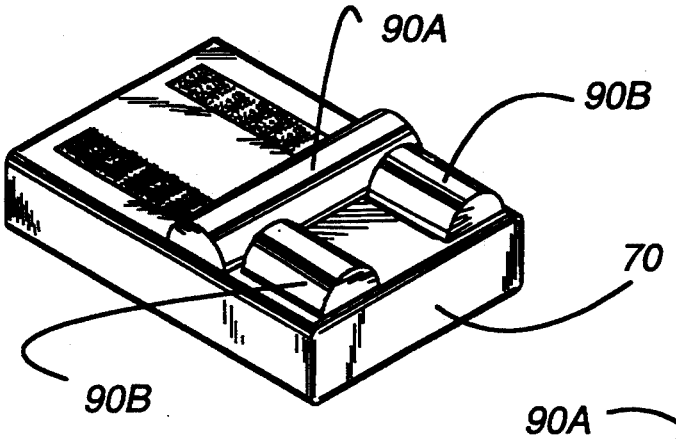
FIGS. 20 and 21 are front and left side perspective views of various cushions that are interconnected to provide a balance seat position for a user, FIG. 20 showing an arrangement wherein the user's feet rest on the floor, and FIG. 21 showing an arrangement wherein the user's feet rest on a cushion in a cross legged position.
Figure 21:
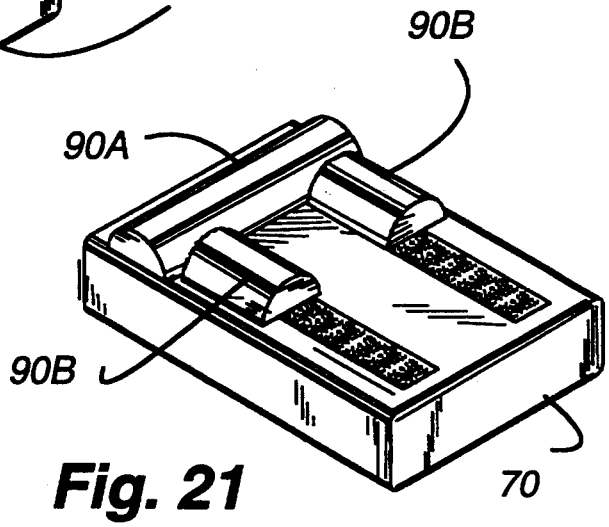

FIG. 19 shows how two long half rolls 90A are bent and attached to an upper wedge cushion 10 and a double inclined cushion 60.

Figure 32:
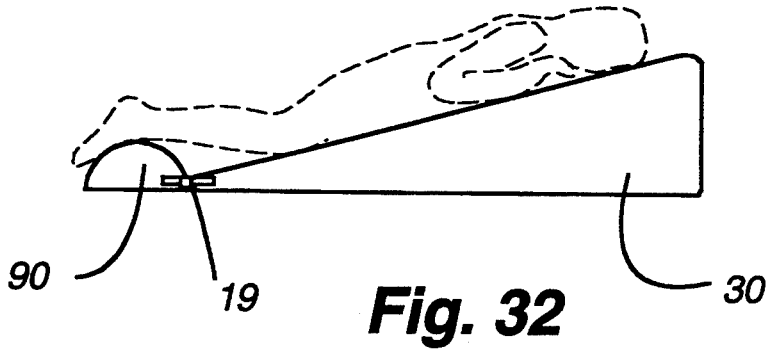
FIG. 32 shows a cushion arrangement similar to FIGS. 28 and 31 using only an inclined wedge cushion and a half-cylinder cushion.
Figure 33:
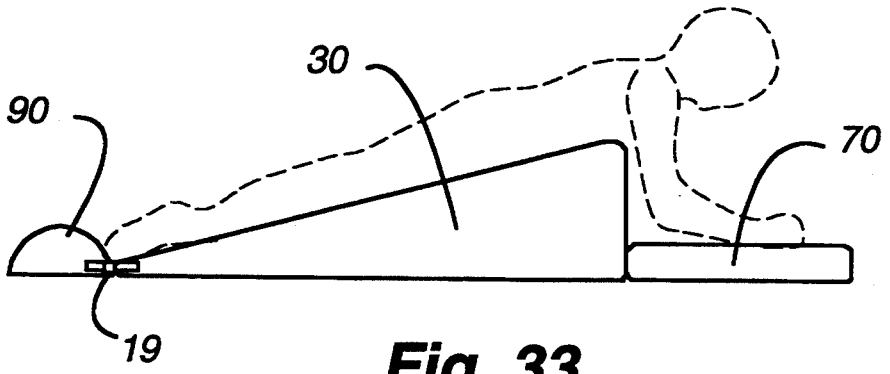
FIG. 33 shows a cushion arrangement similar to FIGS. 28 and 31 wherein the short block cushion of FIGS. 28 and 31 is eliminated.

FIGS. 32–34 show other arrangements wherein half roll cushions 90 are interconnected with a wedge cushion 30. In these arrangements and other half roll cushions 90 are provided with an interconnecting hook 19 on each end thereof.

Figure 13:
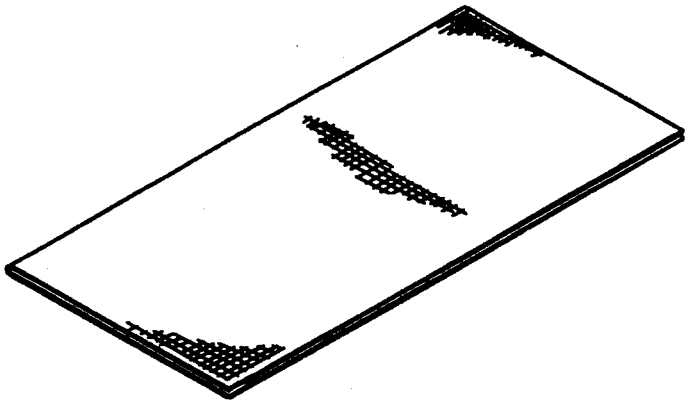
FIGS. 13 and 14 show the construction of the covered hook/loop fastener strips and patches that are used in various surface locations on the above-mentioned cushions, FIG. 13 showing the covered state and FIG. 14 showing the uncovered state.
Figure 14:
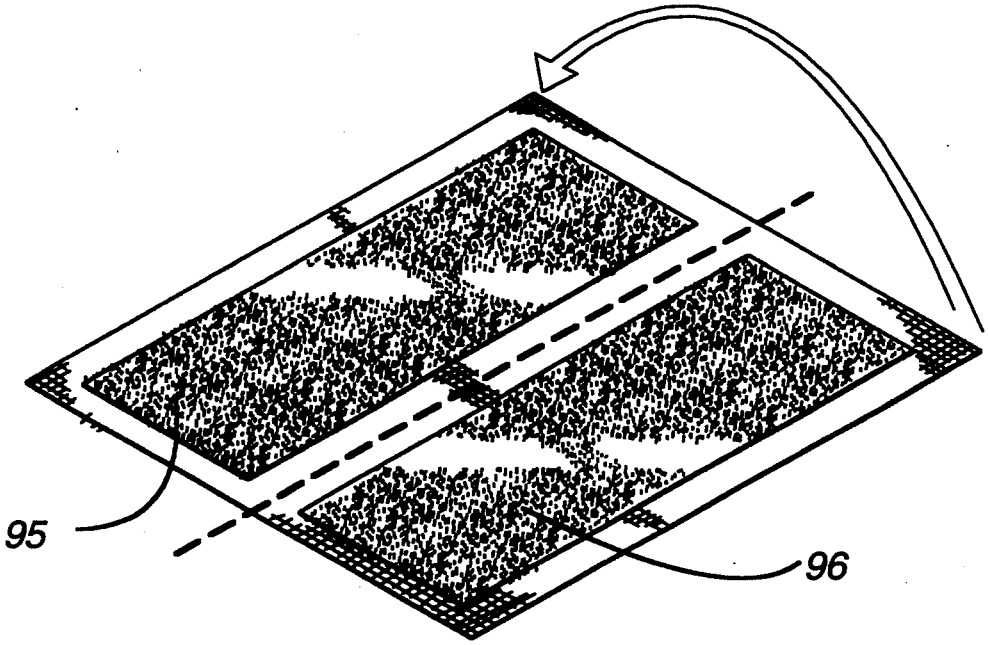

FIGS. 13 and 14 show the construction of covered hook/loop fastener strips and patches that are used in various surface locations on the above-mentioned cushions, FIG. 13 showing the covered state and FIG. 14 showing the uncovered state. As best seen in FIG. 14, each such strip/patch includes a bottom portion 95 that, for example, comprises the loop portion of such a fastener. Cover portion 96 would then contain the hook portion of such a fastener. When cover 96 is placed over bottom portion 95, or vice versa, the cover is securely retained there by virtue of the well-known hook/loop fastening principle. In order to use the strip/patch, cover 96 is pulled off of bottom portion 95, thus exposing the hook and loop portions of the fastener.

While therapeutic arrangements comprising the various cushions in accordance with the invention can take a great many forms, FIGS. 15–61 are illustrative of preferred arrangements. Those skilled in the art will readily visualize yet other cushions and cushion arrangements in accordance with the invention. Thus, it is intended that the spirit and scope of the invention be limited only by the following claims.

What is claimed is:

1. An assembly of therapeutically resilient cushions for placement on a generally horizontal surface to facilitate the support of an individual above said horizontal surface, said assembly comprising;

a first cushion that is shaped as a wedge in cross section, said first cushion being of a horizontal width that exceeds the horizontal width of an individual, said first cushion having an upward facing inclined surface having a low end located adjacent to said surface, and said inclined surface being adapted to support the torso or entire body of an individual, a first pair of generally parallel hook/loop fastener strips spaced apart on said inclined surface so as to form a border outlining a central area of said inclined surface that is to be occupied by the torso of an individual, a second double inclined cushion having a base surface adapted to engage said horizontal surface in abutting relation to said low end of said inclined surface, said second cushion having a triangular cross section in a plane normal to said horizontal surface, and said second cushion being adapted to cooperate with the legs/feet of an individual, coupling means associated with said first and second cushions, said coupling means operating to maintain said first and second cushions as a unitary assembly, and third and fourth linear cushions including fasteners cooperating with the hook/loop fasteners of said first cushion, said third and forth cushions forming a barrier to horizontal movement of an individual and/or providing lateral support to achieve proper alignment of the individual, said third and forth linear cushions being bent to cooperate with said double inclined surface.

2. The assembly of claim 1 wherein said third and forth cushions are half round cross-section cushions.

3. An assembly of therapeutically resilient cushions for placement on a generally horizontal surface to facilitate the support of an individual above said horizontal surface, said assembly comprising;

a first cushion that is shaped as a wedge in cross section, said first cushion being of a horizontal width that exceeds the horizontal width of an individual, said first cushion having an upward facing inclined surface having a low end located adjacent to said surface, and said inclined surface being adapted to support the torso or entire body of an individual, a first pair of generally parallel hook/loop fastener strips spaced apart on said inclined surface so as to form a border outlining a central area of said inclined surface that is to be occupied by an individual, a second cushion located on said horizontal surface in abutting relation to said low end of said inclined surface, said second cushion being adapted to cooperate with the legs/feet of an individual, coupling means associated with said first and second cushions, said coupling means operating to maintain said first and second cushions as a unitary assembly, third and fourth linear cushions including fasteners cooperating with the hook/loop fasteners of said first cushion, said third and forth cushions forming a barrier to horizontal movement of an individual and/or providing lateral support to achieve proper alignment of the individual, and fifth and sixth linear cushions having half round cross section, and including fasteners cooperating with the hook/loop fasteners of said first cushion, said fifth and sixth cushions forming an additional barrier to horizontal movement of an individual.

4. An assembly of cushions for placement on a generally horizontal surface to facilitate support of the body of an individual generally above said horizontal surface, said assembly comprising;

a first wedge cross-section cushion having a horizontal width exceeding an individual's horizontal width, said first cushion having an upward extending central axis located on an upward facing inclined surface, said inclined surface having a bottom end located adjacent to said horizontal surface and extending generally normal to said central axis, and said inclined surface having a top end located a vertical distance above said horizontal surface and extending generally normal to said central axis, a plurality of spaced and generally parallel body confining flexible straps mounted on said inclined surface, said straps being generally centered on said central axis, a second cushion located on said horizontal surface in abutting relation to said bottom end of said inclined surface, coupling means associated with said first and second cushions, said coupling means operating to maintain said first and second cushions as a unitary assembly, said second cushion being a double inclined cross-section cushion having oppositely inclined surfaces, and having a base surface adapted to engage said horizontal surface, and third and forth linear cushions bent to cooperate with said first and second cushions.

5. The assembly of claim 4 including;

a first pair of generally parallel fastener strips spaced apart on said inclined surface, and extending generally from said bottom end to said top end of said inclined surface, said first pair of fastener strips individually extending generally parallel to said central axis surface, and third and forth linear cushions including fasteners cooperating with said first pair of parallel fastener strips, said third and forth cushions providing support and alignment of the torso of the individual.

6. The assembly of claim 4 wherein said second cushion is selected from the group double inclined cross-section cushion and half round cross-section cushion.

7. The assembly of claim 6 wherein said third and forth cushions are half round cross-section cushions.

8. The assembly of claim 4 including;

a first and a second generally parallel flexible strap mounted on said inclined surface, said straps being generally centered on said central axis and extending generally normal to said central axis.

9. The assembly of claim 8 including fifth and sixth linear cushions including fasteners cooperating with the fastener strips of said first cushion, said fifth and sixth cushions forming additional support and alignment of the torso of an individual.

10. The assembly of claim 9 including an additional cushion that is shaped as a wedge in cross section, said additional cushion being located under said first cushion to increase the incline of said upward facing inclined surface.

* * * * *